US007670105B2

(12) United States Patent
Nakata et al.

(10) Patent No.: US 7,670,105 B2
(45) Date of Patent: Mar. 2, 2010

(54) DRAIN PUMP, AND AIR CONDITIONER PROVIDED THEREWITH

(75) Inventors: Haruo Nakata, Osaka (JP); Masakazu Hirai, Osaka (JP); Kazushige Maeda, Osaka (JP); Hironori Iwanaga, Osaka (JP); Tsunehisa Sanagi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 12/176,112

(22) Filed: Jul. 18, 2008

(65) Prior Publication Data

US 2008/0286096 A1 Nov. 20, 2008

Related U.S. Application Data

(63) Continuation of application No. 10/548,430, filed as application No. PCT/JP2004/017773 on Nov. 30, 2004, now Pat. No. 7,435,048.

(30) Foreign Application Priority Data

Dec. 5, 2003 (JP) ..... 2003-406758
Feb. 25, 2004 (JP) ..... 2004-050132

(51) Int. Cl.
*F04D 29/28* (2006.01)

(52) U.S. Cl. ..... 415/143; 415/176; 415/178; 415/199.6; 415/119; 416/201 A; 416/228; 416/236 R; 416/237; 416/175; 416/203; 62/280

(58) Field of Classification Search ..... 415/119, 415/143, 176, 177, 178, 199.6, 228; 416/175, 416/203, 198 R, 200 R, 201 A, 228, 235, 416/236 R, 237, 183, 185, 188; 62/280
See application file for complete search history.

(56) References Cited

U.S. PATENT DOCUMENTS

| | | | | |
|---|---|---|---|---|
| 2,971,748 | A | 2/1961 | Ellegast | |
| 5,605,439 | A | 2/1997 | Endoh et al. | |
| 5,628,618 | A | 5/1997 | Imai et al. | |
| 5,961,283 | A | 10/1999 | Imai et al. | |
| 7,435,048 | B2 * | 10/2008 | Nakata et al. | 415/143 |

FOREIGN PATENT DOCUMENTS

| | | | |
|---|---|---|---|
| CN | 1150233 | A | 5/1997 |
| JP | 10-115294 | A | 5/1998 |
| JP | 2591739 | Y2 | 1/1999 |

(Continued)

*Primary Examiner*—Christopher Verdier
(74) *Attorney, Agent, or Firm*—Global IP Counselors

(57) ABSTRACT

A drain pump is provided that reduces the operating noise when the head is low. The drain pump has a pump casing, and an impeller. The pump casing has a drain inlet for sucking in drain water at a lower end part and a drain outlet for discharging drain water at a side part. The impeller has a shaft part disposed extending in a vertical direction inside the pump casing, a main blade disposed on the outer circumferential side of the shaft part, an auxiliary blade disposed on the lower side of the main blade, and a disc shaped dish part disposed between the main blade and the auxiliary blade. The dish part has an annular partition part extending upward from the outer circumferential edge part of the main blade, which is disposed at a position lower than the upper end part of the partition part.

4 Claims, 17 Drawing Sheets

FOREIGN PATENT DOCUMENTS

| | | | |
|---|---|---|---|
| JP | 2877497 | B2 | 1/1999 |
| JP | 2000-046363 | A | 2/2000 |
| JP | 2000-080996 | A | 3/2000 |
| JP | 2000-240581 | A | 9/2000 |
| JP | 2001-123977 | A | 5/2001 |
| JP | 2001-342984 | A | 12/2001 |
| JP | 2002-005082 | A | 1/2002 |
| JP | 2002-048092 | A | 2/2002 |
| JP | 2003-293976 | A | 10/2003 |

* cited by examiner

DRAIN PUMP, AND AIR CONDITIONER PROVIDED THEREWITH

CROSS-REFERENCE TO RELATED APPLICATIONS

This application is a continuation application of U.S. patent application Ser. No. 10/548,430 filed on Sep. 8, 2005, now U.S. Pat. No. 7,435,048, which is a National Stage application of International Patent Application No. PCT/JP2004/017773 filed on Nov. 30, 2004. The entire disclosure of U.S. patent application Ser. No. 10/548,430 is hereby incorporated herein by reference.

This application claims priority to Japanese Patent Application Nos. 2003-406758 and 2004-050132 respectively filed on Dec. 5, 2003 and Feb. 25, 2004. The entire disclosures of Japanese Patent Application Nos. 2003-406758 and 2004-050132 are hereby incorporated herein by reference.

FIELD OF THE INVENTION

The present invention relates to a drain pump, and an air conditioner provided therewith.

BACKGROUND ART

It is known to provide a drain pump in an air conditioner in order to discharge drain water generated in a heat exchanger during cooling operation, draining operation, and the like. Such a drain pump is built into a ceiling embedded type air conditioner 1 as shown in, for example, FIG. 14, FIG. 15, and FIG. 16. Here, FIG. 14 is an external perspective view of the air conditioner 1 (ceiling is not shown). FIG. 15 is a schematic side cross sectional view of the air conditioner 1, and is a cross sectional view taken along the A-A line in FIG. 16. FIG. 16 is a schematic plan cross sectional view of the air conditioner 1, and is a cross sectional view taken along the B-B line in FIG. 15.

The air conditioner 1 comprises a casing 2 that internally houses various constituent equipment, and a face panel 3 disposed on the lower side of the casing 2. Specifically, the casing 2 of the air conditioner 1 is disposed so that it is inserted in an opening formed in a ceiling U of an air conditioned room. Furthermore, the face panel 3 is disposed so that it is fitted into the opening of the ceiling U. Principally disposed inside the casing 2 are: a fan 4 that sucks air inside the air conditioned room through an inlet 31 of the face panel 3 into the casing 2, and blows the same out in the outer circumferential direction; and a heat exchanger 6 disposed so that it surrounds the outer circumference of the fan 4. In the face panel 3 are formed: an inlet 31 that sucks in the air inside the air conditioned room; and outlets 32 that blow out the air from inside the casing 2 into the air conditioned room.

A drain pan 7 for receiving the drain water generated in the heat exchanger 6 is disposed on the lower side of the heat exchanger 6. The drain pan 7 is mounted to the lower part of the casing 2. The drain pan 7 comprises: an inlet 71 formed so that it communicates with the inlet 31 of the face panel 3; outlets 72 formed so that they correspond to the outlets 32 of the face panel 3; and a drain receiving groove 73 formed on the lower side of the heat exchanger 6 and that receives the drain water. In addition, a bell mouth 5 for guiding the air sucked in from the inlet 31 to the impeller 41 of the fan 4 is disposed in the inlet 71 of the drain pan 7. Further, a drain pump 308 that discharges the drain water collected in the drain receiving groove 73 out of the casing 2 is disposed in the portion of the drain receiving groove 73 of the drain pan 7 where the heat exchanger 6 is not disposed (specifically, between the outlets 72). The drain pump 308 is connected via a discharge pipe (not shown) disposed outside of the casing 2.

As shown in FIG. 17, such a drain pump 308 principally comprises: a pump casing 81 comprising a drain inlet 81*a* at the lower end part and a drain outlet 81*b* at the side part; an impeller 382 disposed inside the pump casing 81 and capable of rotating about a shaft part 91 extending in the vertical direction inside the pump casing 81; and a motor 83 disposed on the upper side of the pump casing 81 and that rotationally drives the shaft part 91 of the impeller 382. A motor fitting 89 for affixing the drain pump 308 to the casing 2 of the air conditioner 1 is mounted on the side surface of the motor 83. Here, FIG. 17 is a side view of the conventional drain pump 308 (depicting a cross section of the pump casing 81). In addition, the rotational axis line of the shaft part 91 of the impeller 382 is the P-P line.

The pump casing 81 principally comprises: a casing main body 84 comprising an opening at the upper part and disposed so that it surrounds the sides of the impeller 382; a casing cover 85 disposed so that it covers the opening of the upper part of the casing main body 84; and a sealing member 86 for sealing the space between the casing main body 84 and the casing cover 85. The casing main body 84 comprises: a cylindrically shaped main body part 84*a* whose diameter decreases in the downward direction; a tubular shaped suction part 84*b* comprising a drain inlet 81*a* at the lower end part and extending downward from the lower end part of the main body part 84*a*; and a tubular shaped discharge nozzle part 84*c* extending sideways from the drain outlet 81*b* formed at the side part of the main body part 84*a*. As shown in FIG. 16, one part of the discharge nozzle part 84*c* passes through a side plate of the casing 2 of the air conditioner 1. The casing cover 85 principally comprises an air introduction part 85*a* comprising a through hole substantially at the center that communicates with the atmosphere and the inside of the pump casing 81.

As shown in FIG. 18 and FIG. 19, the impeller 382 principally comprises: the shaft part 91 coupled to the drive shaft of the motor 83; a main blade 392 disposed inside the main body part 84*a*; an auxiliary blade 94 disposed on the lower side of the main blade 392; and a disc shaped dish part 93 disposed between the main blade 392 and the auxiliary blade 94, and having an opening 93*a* comprising an annular through hole at the center. Here, FIG. 18 is an enlarged view that depicts the vicinity of the pump casing 81 of FIG. 17. FIG. 19 is a plan view of the conventional drain pump 308 (the motor 83 and the casing cover 85 are not shown).

The shaft part 91 passes through the inside of the air introduction part 85*a*, and is disposed so that a gap is formed between the outer circumferential surface of the shaft part 91 and the inner circumferential surface of the air introduction part 85*a* of the casing cover 85.

The main blade 392 comprises, for example: four first blades 395 extending radially from the outer circumferential surface of the shaft part 91; and four second blades 396 extending radially from the outer circumferential edge part of the opening 93*a* of the dish part 93, and disposed between the first blades 395 in the circumferential direction. The height position of the upper end part of each first blade 395 (hereinafter, the height of each first blade 395 and each second blade 396 from the upper end surface of the opening 93*a* to the upper end part is defined as a blade height H1, as shown in FIG. 18) is the same height from the inner circumferential part to the outer circumferential part thereof. In addition, the blade height H1 of the upper end part of each second blade 396 from the inner circumferential part to the outer circumferential part thereof is the same height as each first blade 395.

The dish part 93 is disposed along a reduced diameter portion of the main body part 84*a*, and the annular partition part 93*b* extending upward from the outer circumferential edge part thereof is disposed so that it couples with the outer circumferential edge part of the main blade 392. The upper end part of the partition part 93*b* is disposed at a position lower than the upper end part of the main blade 392 (hereinafter, the height from the upper end surface of the opening 93*a* to the upper end part of the partition part 93*b* of the dish part 93 is defined as a dish height H2, as shown in FIG. 18). In other words, the upper end part of the main blade 392, viewed from the side of the impeller 382, protrudes more on the upper side than the upper end part of the partition part 93*b*. In addition, an external dimension D of the partition part 93*b* is substantially the same or slightly less than the outer diameter of the main blade 392. The auxiliary blade 94 is disposed inside the suction part 84*b*, and comprises four blades extending radially from the outer circumferential surface of the shaft part 91.

The impeller 382 of the drain pump 308 so constituted rotates in a prescribed direction when the motor 83 is driven. In so doing, a part of the suction part 84*b* is submerged to a point lower than the water surface of the drain water collected in the drain receiving groove 73 of the drain pan 7, and the drain water collected in the drain receiving groove 73 is consequently sucked in from the drain inlet 81*a* by the auxiliary blade 94, rises inside the suction part 84*b*, and reaches the main body part 84*a*. Further, the drain water that reaches the main body part 84*a* is boosted by the main blade 392, and then discharged from the drain outlet 81*b* via the discharge nozzle part 84*c* to the outside of the casing 2 of the air conditioner 1. Specifically, the drain water discharged from the drain outlet 81*b* is discharged via the discharge pipe disposed outside of the casing 2 and connected to the discharge nozzle part 84*c*. Here, the water surface that rose to the main body part 84*a* is substantially vertically divided into parts by the dish part 93, the flow of the drain water is partially blocked so that the flow is limited, and the drain water that contacts the main blade 392 is discharged (e.g., refer to Japanese Published Patent Application No. H10-115294, 2000-80996, 2000-240581, and 2001-342984).

Moreover, the discharge flow rate can be regulated by the water level h (refer to FIG. 18), without the drain pump 308 starting and stopping. In other words, the drain pump 308 is constituted so that the discharge flow rate decreases if the water level h falls, and the discharge flow rate increases if the water level h rises. Further, if the water level h rises to a certain water level and reaches the maximum discharge flow rate, then the discharge flow rate will no longer change even if the water level h rises further than that. Consequently, even if the amount of drain water generated in the heat exchanger 6 varies, stable operation is performed with a water level that balances the amount of drain water generated with the discharge flow rate.

Here, as the water level h inside the main body part 84*a* of the drain pump 308 falls, an air layer expands (refer to an air-liquid interface X in FIG. 18 and FIG. 19) circularly concentric with the shaft part 91 of the main blade 392, which consequently decreases the effective area by which the main blade 392 can perform the work of supplying water, and reduces the discharge flow rate of the drain pump 308. Conversely, if the water level h rises, then the air layer shrinks, which consequently increases the effective area by which the main blade 392 can perform the work of supplying water, and increases the discharge flow rate of the drain pump 308. Thus, the conventional drain pump 308 is structured so that the discharge flow rate can be regulated by the water level h.

In addition, the back pressure may decrease depending on, for example, the installation conditions (piping length, inner diameter, height, etc.) of the discharge pipe connected to the drain outlet 81*b*. In such a case, the head of the drain pump 308 decreases, which consequently expands the air layer circularly concentric with the shaft part 91 of the main blade 392.

Compared with a pump of a type wherein an impeller is generally submerged completely, such a drain pump 308 is constituted so that the air-liquid interface between the air and the water is formed at a portion where the main blade 392 is disposed; consequently, the pump efficiency is low and the operating noise is loud. Further, this operating noise is generated principally by the agitation of the air layer by the main blade 392, and the air layer acceleratedly increases the more it expands on the outer circumferential side of the main blade 392. Particularly when the head is low, the air-liquid interface between the air and the water (refer to an air-liquid interface Y in FIG. 18 and FIG. 19) expands to the outer circumferential part, where the circumferential velocity is high, which consequently generates an extremely loud operating noise. This operating noise becomes a problem particularly if the flow rate of the fan 4 of the air conditioner 1 is low, or if the inside of the air conditioned room is quiet.

In contrast, with the aim of reducing the operating noise by making the air-liquid interface Y above the upper end part of the partition part 93*b* flow smoothly, it is also known to employ the impeller 382 provided with inclined parts 395*a*, 396*a* at the outer circumferential part of the main blade 392 (specifically, the first and second blades 395, 396) only at the portion on the upper side of the upper end part of the partition part 93*b* (i.e., the portion between the blade height H1 and the dish height H2), as shown in FIG. 20; however, even in this case, the operating noise cannot be sufficiently reduced.

SUMMARY OF THE INVENTION

It is an object of the present invention to reduce the operating noise of a drain pump when the head is low.

A drain pump according to the first invention comprises a casing and an impeller. The casing comprises: a drain inlet for sucking in drain water at a lower end part; and a drain outlet for discharging drain water at a side part. The impeller comprises: a shaft part disposed inside the casing so that it extends in the vertical direction; a main blade disposed on the outer circumferential side of the shaft part; an auxiliary blade disposed on the lower side of the main blade; and a disc shaped dish part disposed between the main blade and the auxiliary blade and comprising an opening in the center. The dish part further comprises an annular partition part extending upward from the outer circumferential edge part thereof. The outer circumferential edge part of the main blade is disposed at a position lower than the upper end part of the partition part.

With this drain pump, the outer circumferential edge part of the main blade, where the circumferential velocity is high, is disposed at a position lower than the upper end part of the partition part; consequently, even if the air-liquid interface between the air and the water expands to the outer circumferential part, where the circumferential velocity is high, when the head is low, the collision between the air-liquid interface and the outer circumferential part of the main blade can be softened, and the operating noise can be reduced. The operating noise can be reduced effectively particularly if an operating condition of low head overlaps an operating condition of low water level.

Moreover, because the portion disposed at a position lower than the upper end part of the partition part is the outer circumferential edge part of the main blade, which has a high circumferential velocity and significantly affects operating noise, it reduces the effect of softening the collision between the air-liquid interface and the main blade for the inner circumferential part of the main blade, which has a comparatively small effect on operating noise, while softening the collision between the air-liquid interface and the main blade in the vicinity of the outer circumferential edge part of the main blade, and ensures an effective area by which the main blade can perform the work of supplying water, which enables a drop in performance of the drain pump to be suppressed as much as possible.

Thereby, with this drain pump, the operating noise can be reduced when the head is low while suppressing a drop in the pump performance.

A drain pump according to the second invention is the drain pump according to the first invention, wherein the outer circumferential edge part of the main blade is disposed on the inner circumferential side of the inner circumferential surface of the partition part.

With this drain pump, the outer circumferential edge part of the main blade is disposed on the inner circumferential side of the inner circumferential surface of the partition part of the dish part, and the diameter of the main blade is less than the diameter of inner circumferential surface of the dish part; consequently, it is possible to enhance the effect of softening the collision between the air-liquid interface and the main blade at the outer circumferential edge part of the main blade.

A drain pump according to the third invention is the drain pump according to the first invention or the second invention, wherein the outer circumferential part of the main blade is inclined so that a blade height decreases toward the outer circumferential edge part.

With this drain pump, the main blade is formed so that the blade height of the outer circumferential part of the main blade decreases toward the outer circumferential edge part, and it is easier to further ensure an effective area at the outer circumferential part of the main blade by which the main blade can perform the work of supplying water; consequently, it is possible to further suppress a drop in the performance of the drain pump.

A drain pump according to the fourth invention comprises a casing and an impeller. The casing comprises: a drain inlet for sucking in drain water at a lower end part; and a drain outlet for discharging drain water at a side part. The impeller comprises: a shaft part disposed inside the casing so that it extends in the vertical direction; a main blade disposed on the outer circumferential side of the shaft part; an auxiliary blade disposed on the lower side of the main blade; and a disc shaped dish part disposed between the main blade and the auxiliary blade and comprising an opening in the center. The main blade is formed so that the blade height decreases from the inner circumferential edge part toward the outer circumferential edge part thereof.

With this drain pump, the blade height of the main blade decreases from the inner circumferential edge part toward the outer circumferential edge part; consequently, it is possible to soften the collision between the air-liquid interface and the main blade in any of these cases: the case where, when the head is low, the air-liquid interface between the air and the water expands to the outer circumferential part, where the circumferential velocity is high; and the case where, when the head is low, the air-liquid interface is positioned at the inner circumferential part, more so in the case when the water level is rising than when the water level is low.

Thereby, with this drain pump, the operating noise can be reduced when the head is low, even if the position of the air-liquid interface varies due to variations in the water level.

A drain pump according to the fifth invention comprises a casing and an impeller. The casing comprises: a drain inlet for sucking in drain water at a lower end part; and a drain outlet for discharging drain water at a side part. The impeller comprises: a shaft part disposed inside the casing so that it extends in the vertical direction; a main blade disposed on the outer circumferential side of the shaft part; an auxiliary blade disposed on the lower side of the main blade; and a disc shaped dish part disposed between the main blade and the auxiliary blade and comprising an opening in the center. The jagged part, wherein the blade height varies with the jagged shape, is formed at least the outer circumferential part of the main blade.

With this drain pump, a jagged part is formed at the outer circumferential part of the main blade, where the circumferential velocity is high; consequently, even if, when the head is low, the air-liquid interface between the air and the water expands to the outer circumferential part where the circumferential velocity is high, the collision between the air-liquid interface and the outer circumferential part of the main blade can be softened, and the operating noise can be reduced. The operating noise can be reduced effectively particularly if the operating condition of low head overlaps the operating condition of low water level.

Moreover, if the jagged part is formed also at the inner circumferential part of the main blade, the collision between the air-liquid interface and the main blade can be softened in any one of these cases: the case where, when the head is low, the air-liquid interface between the air and the water expands to the outer circumferential part, where the circumferential velocity is high; and the case where, when the head is low, the air-liquid interface is positioned at the inner circumferential part, more so in the case when the water level is rising than when the water level is low.

Thereby, with this drain pump, the operating noise can be reduced when the head is low, even if the position of the air-liquid interface varies due to variations in the water level.

An air conditioner according to the sixth invention comprises: a heat exchanger; a drain pan for collecting drain water generated by the heat exchanger; and a drain pump as recited in any one invention of the first invention through the fifth invention that discharges the drain water collected in the drain pan.

With this air conditioner, the noise of the entire air conditioner can be reduced because the drain pump whose operating noise is low when the head is low is used to discharge the drain water collected in the drain pan.

DETAILED DESCRIPTION OF THE PREFERRED EMBODIMENTS

The following explains the embodiments of a drain pump and an air conditioner provided therewith according to the present invention, referencing the drawings.

First Embodiment

(1) Constitution and Operation of the Drain Pump

Figure 1:
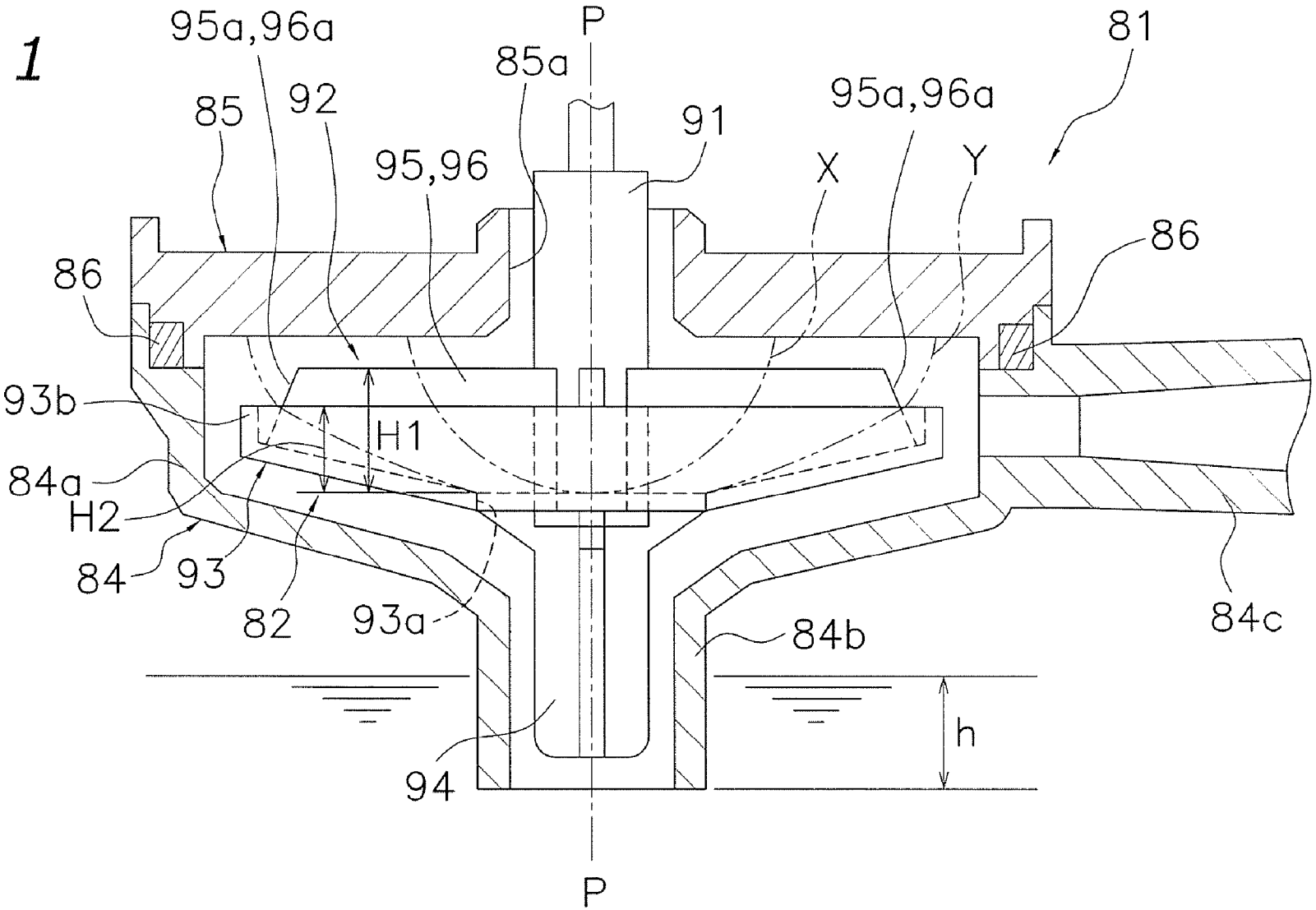
FIG. 1 is an enlarged view that depicts the vicinity of a pump casing of a drain pump according to the first embodiment of the present invention.
Figure 2:
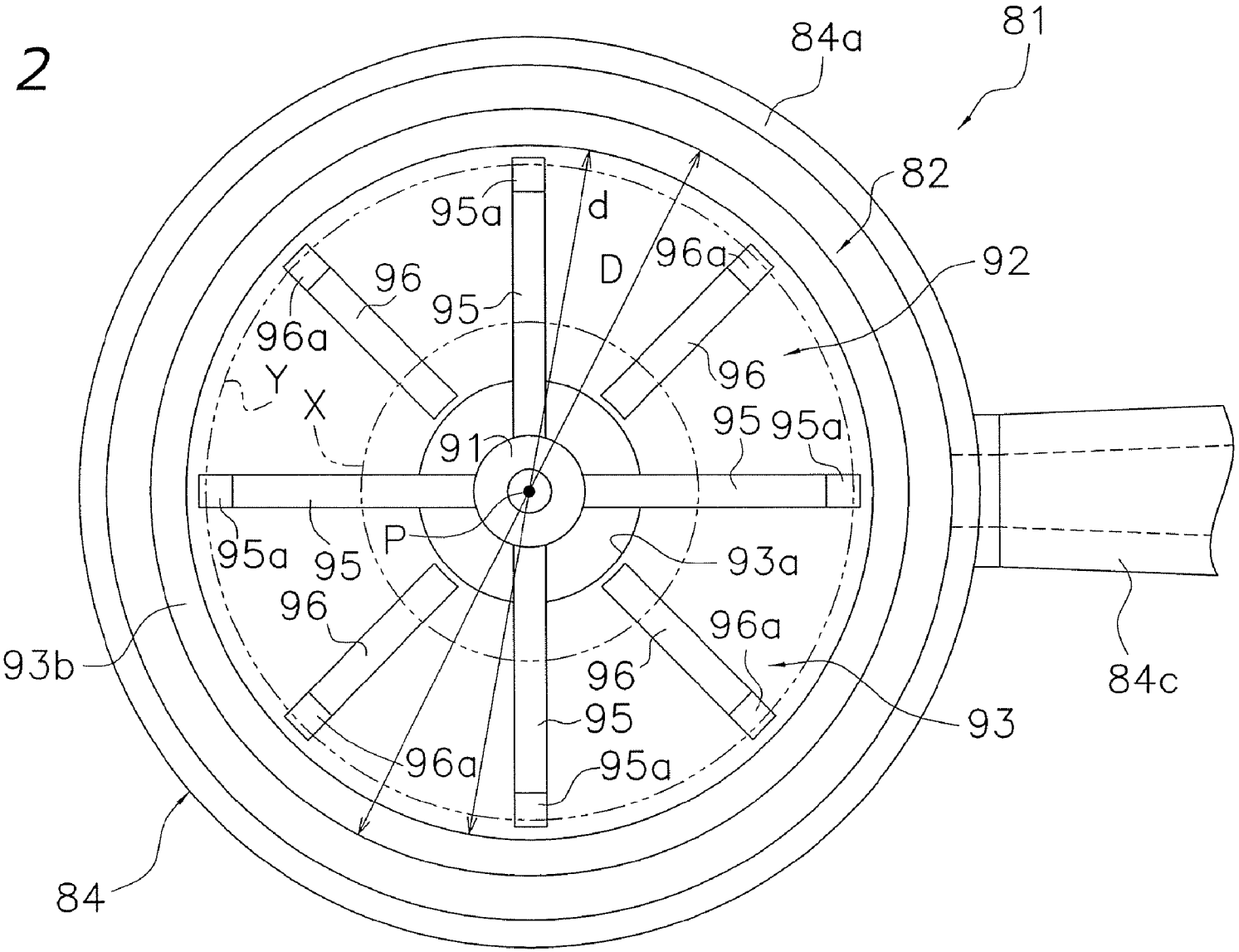
FIG. 2 is a plan view of the drain pump (the motor and the casing cover are not shown) according to the first embodiment of the present invention.
Figure 14:
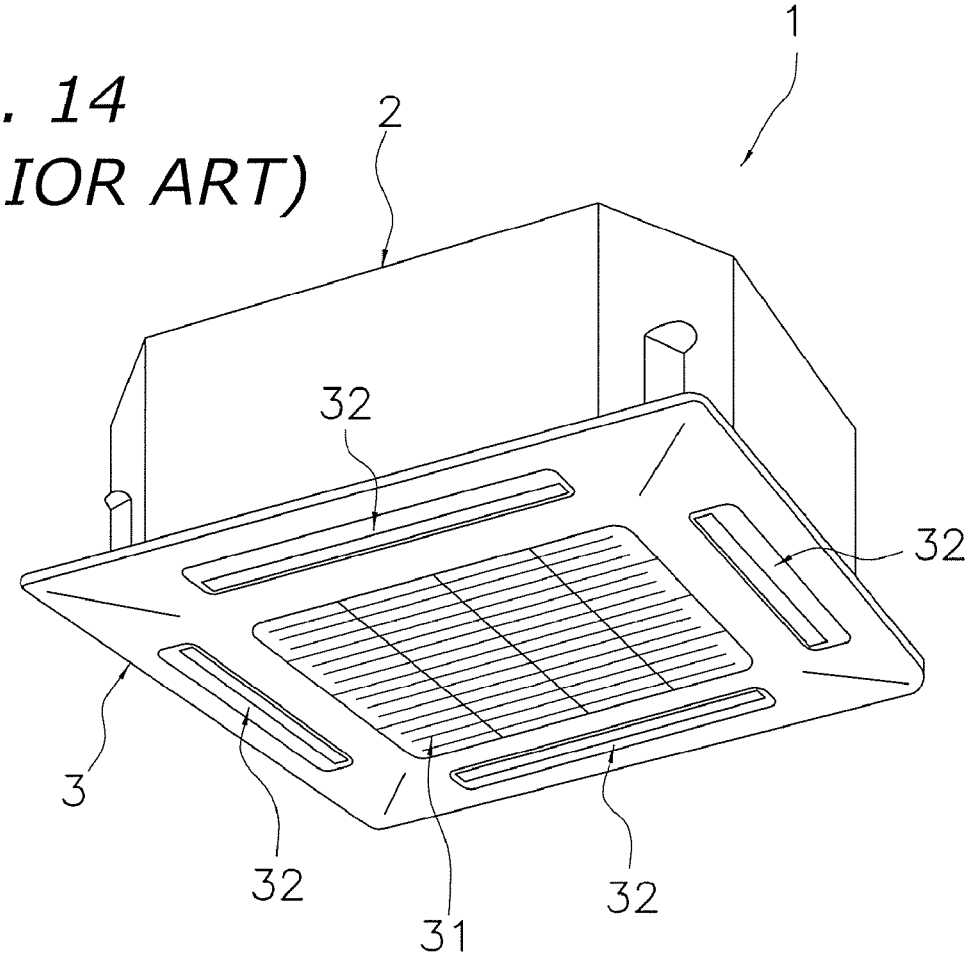
Fig. 14 (PRIOR ART)
FIG. 14 is an external perspective view of a ceiling embedded type air conditioner.
Figure 15:
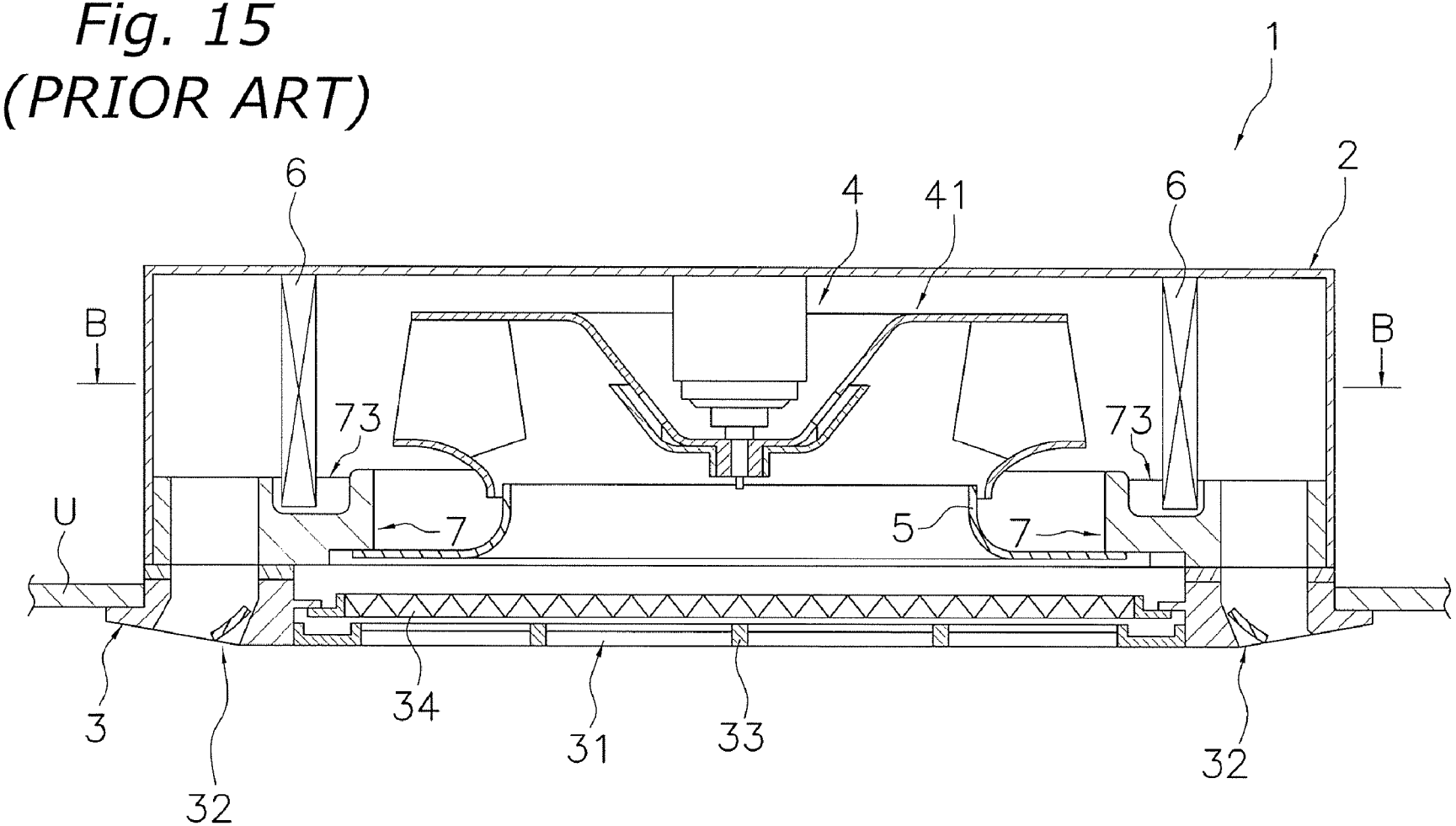
Fig. 15 (PRIOR ART)
FIG. 15 is a schematic side cross sectional view of the ceiling embedded type air conditioner, and is a cross sectional view taken along the A-A line in FIG. 16.
Figure 16:
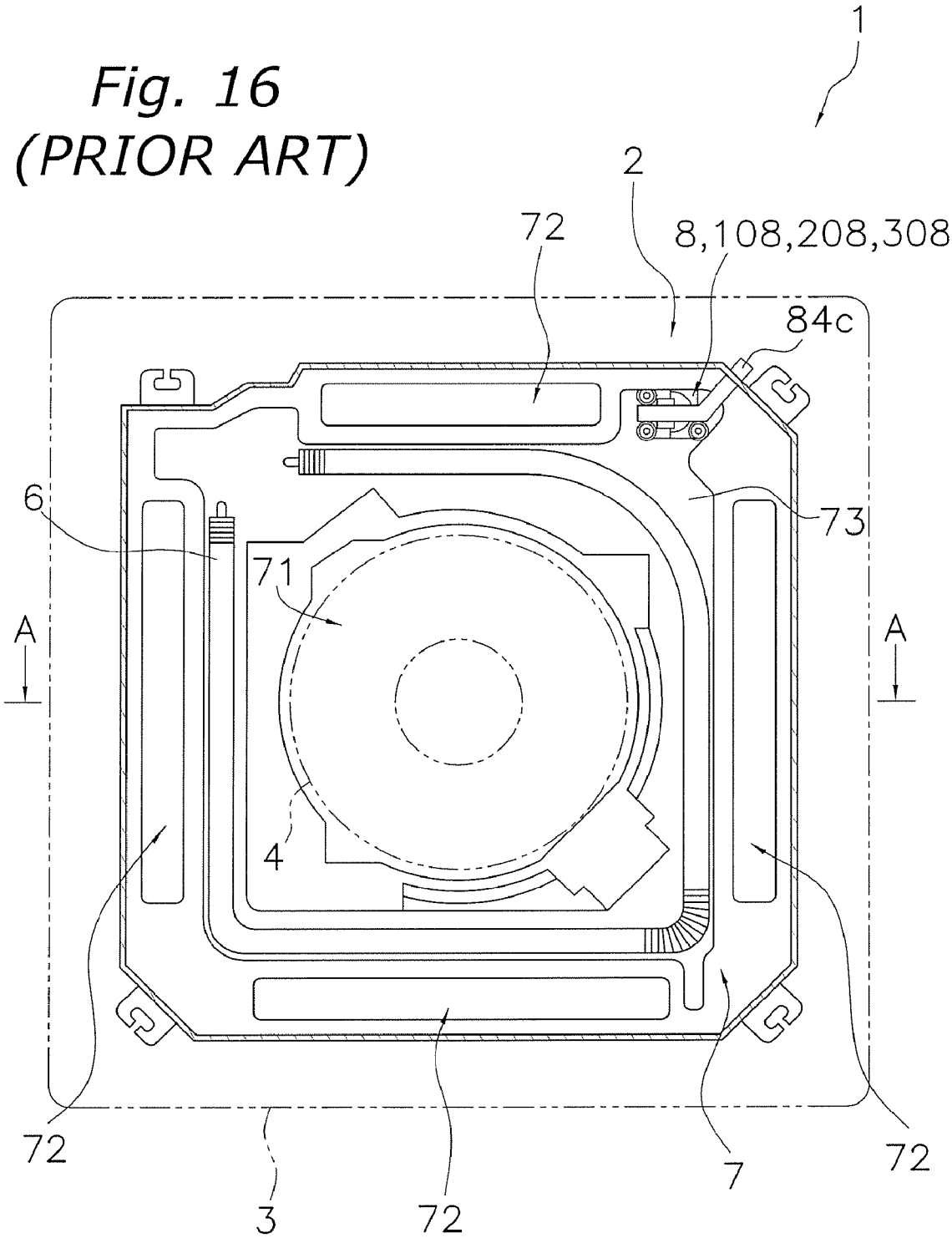
Fig. 16 (PRIOR ART)
FIG. 16 is a schematic plan cross sectional view of the ceiling embedded type air conditioner, and is a cross sectional view taken along the B-B line in FIG. 15.
Figure 17:
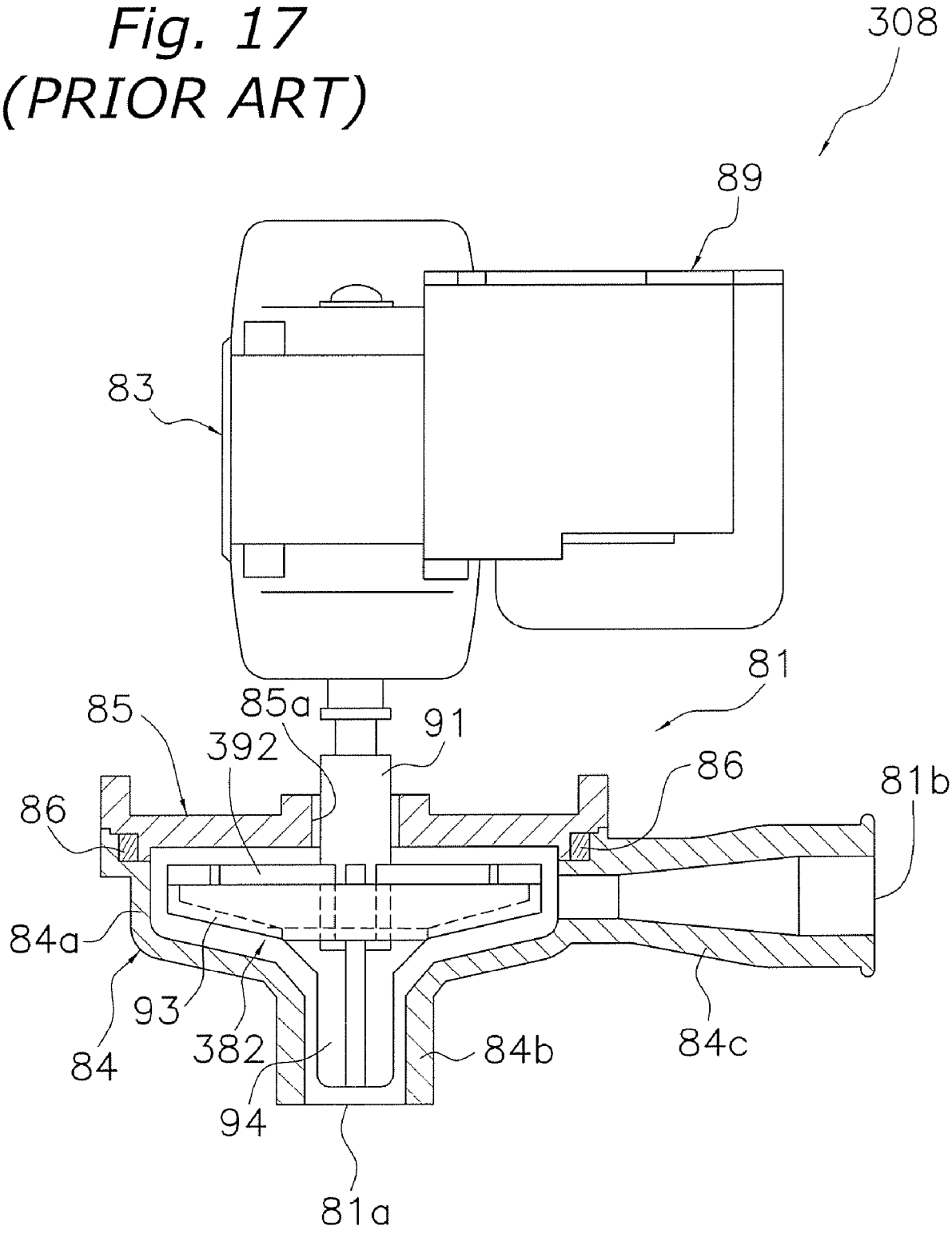
Fig. 17 (PRIOR ART)
FIG. 17 is a side view of a conventional drain pump (depicting a cross section of the pump casing).

FIG. 1 and FIG. 2 depict a drain pump 8 according to the first embodiment of the present invention used in an air conditioner 1 (refer to FIG. 14 through FIG. 16), and the like. Here, FIG. 1 is an enlarged view that depicts the vicinity of a pump casing 81 of the drain pump 8 according to the first embodiment of the present invention. FIG. 2 is a plan view of the drain pump 8 (a motor 83 and a casing cover 85 are not shown) according to the first embodiment of the present invention. Furthermore, excepting an impeller 82, the explanation of the drain pump 8 is abbreviated because its constitution is the same as that of the conventional drain pump 308.

The impeller 82 principally comprises: a shaft part 91 coupled to a drive shaft of the motor 83; a main blade 92 disposed inside a main body part 84*a* of the pump casing 81; an auxiliary blade 94 disposed on the lower side of the main blade 92; and a disc shaped dish part 93 disposed between the main blade 92 and the auxiliary blade 94, and having an opening 93*a* comprising an annular through hole in the center. Here, excepting the main blade 92, the explanation of the impeller 82 is abbreviated because its constitution is the same as a conventional impeller 382.

The main blade 92 comprises, for example: four first blades 95 extending radially from the outer circumferential surface of the shaft part 91; and four second blades 96 extending radially from the outer circumferential edge part of the opening 93*a* of the dish part 93, and disposed between the first blades 95 in the circumferential direction. Furthermore, the number of first blades 95 and second blades 96 that constitute the main blade 92 is not limited to the abovementioned number, and various numbers thereof can be chosen.

The height position of the upper end part of each first blade 95 (hereinafter, the height of each first blade 95 and each second blade 96 from the upper end surface of the opening 93*a* is defined as a blade height H1, as shown in FIG. 1) is the same height from the inner circumferential part to the outer circumferential part thereof, excepting an inclined part 95*a* formed at the outer circumferential part. In addition, the blade height H1 of the upper end part of each second blade 96 from the inner circumferential part to the outer circumferential part thereof is the same height as each first blade 95, excepting an inclined part 96*a* formed at the outer circumferential part. Moreover, the same as a main blade 392 of the conventional drain pump 308, the portion excluding the inclined part 96*a* of the main blade 92 protrudes more on the upper side than the upper end part of a partition part 93*b* (specifically, a dish height H2) when viewed from the side surface of the impeller 82.

Furthermore, the inclined parts 95*a*, 96*a* are formed so that one part of the outer circumferential part of each first blade 95 and each second blade 96 is notched, and are shaped inclined so that the blade height H1 shortens toward the outer circumferential edge part. In addition, the outer circumferential edge part of each of the inclined parts 95*a*, 96*a* is disposed at a position lower than the upper end part of the partition part 93*b*.

In addition, the inclined parts 95*a*, 96*a* are notched so that the outer diameter of each first blade 95 and each second blade 96 is shorter than an external dimension D of the partition part 93*b*, and further is shorter than a diameter d of the inner circumferential surface of the partition part 93*b*. Consequently, the outer circumferential edge part of each first blade 95 and each second blade 96 is disposed on the inner circumferential side of the inner circumferential surface of the partition part 93*b*. Furthermore, each of the inclined parts 95*a*, 96*a* may be shaped linearly inclined, as shown in FIG. 1, and may be shaped inclined so that it describes a curved surface.

With a drain pump 8 having a main blade 92 wherein such inclined parts 95*a*, 96*a* are formed, the air layer expands circularly concentric with the shaft part 91 of the main blade 92 as the water level h falls, the same as the inside of the main body part 84*a* of a conventional drain pump 308. Particularly when the head is low, the air-liquid interface between the air and the water (refer to an air-liquid interface Y in FIG. 1 and FIG. 2) expands to the outer circumferential part where the circumferential velocity is high.

However, with the drain pump 8, the outer circumferential edge part of the main blade 92 is disposed at a position lower than the upper end part of the partition part 93*b* by the forming of the inclined parts 95*a*, 96*a* at the outer circumferential part of the main blade 92, which can soften the collision between the air-liquid interface Y and the outer circumferential part of the main blade 92, and it is consequently possible to reduce the operating noise generated by the agitation of the air layer by the main blade 92.

Moreover, because the portion disposed at a position lower than the upper end part of the partition part 93*b* is the outer circumferential edge part of the main blade 92, which has a high circumferential velocity and greatly affects operating noise: it decreases the effect of softening the collision between the air-liquid interface and the main blade for the inner circumferential part of the main blade 92, which has a comparatively small effect on operating noise, while softening the collision between the air-liquid interface Y and the main blade in the vicinity of the outer circumferential edge part of the main blade 92; and it ensures an effective area by which the main blade 92 can do the work of supplying water. Thereby, a decrease in the discharge flow rate of the drain pump 8 is suppressed, and a drop in pump performance can be kept to a minimum.

In addition, with the drain pump 8, the outer circumferential edge part of the main blade 92 is disposed on the inner circumferential side of the inner circumferential surface of the partition part 93*b* of the dish part 93, and it is consequently possible to obtain the effect of reliably softening the collision between the air-liquid interface Y and the main blade 92 at the outer circumferential edge part of the main blade 92.

Furthermore, with the drain pump 8, the main blade 92 is formed so that the blade height H1 of the outer circumferential part of the main blade 92 decreases toward the outer circumferential edge part, which makes it easier to ensure an effective area at the outer circumferential part of the main blade 92 by which the main blade 92 can perform the work of supplying water, and it is consequently possible to further suppress a drop in the pump performance of the drain pump 8.

Thus, with this drain pump 8, a drop in the pump performance can be suppressed and the operating noise can be reduced when the head is low. In addition, because such a drain pump 8 having a low operating noise when the head is low is used to discharge the drain water collected in a drain pan 7 of the air conditioner 1, it becomes possible to reduce the noise of the entire air conditioner 1, and problems such as the operating noise of the drain pump becoming a disturbance tend not to occur in cases such as when the flow rate of a fan 4 of the air conditioner 1 is low, or when the interior of the air conditioned room is quiet.

(2) Examples of Experiments

Figure 18:
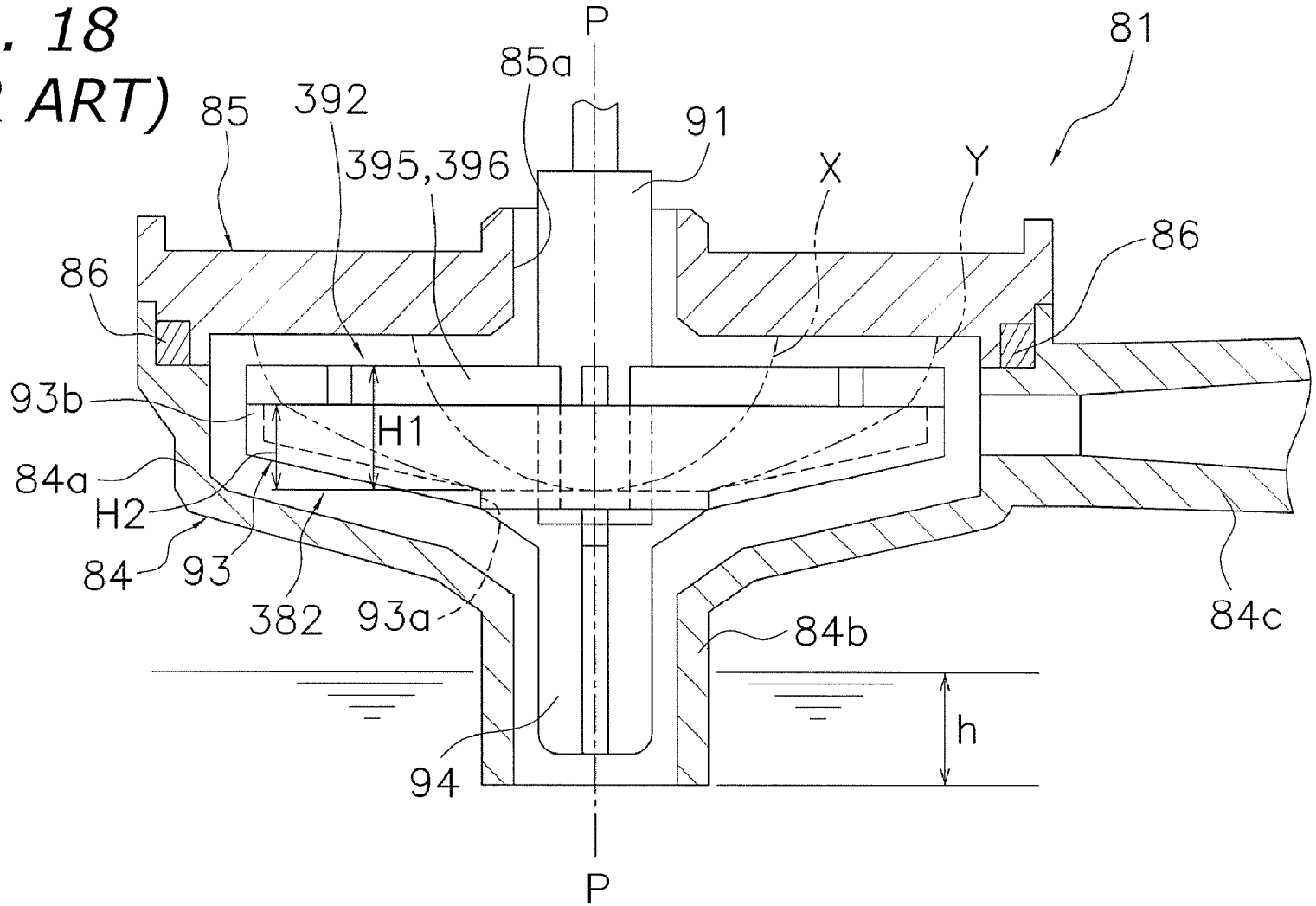
Fig. 18 (PRIOR ART)
FIG. 18 is an enlarged view that depicts the vicinity of the pump casing in FIG. 17.
Figure 19:
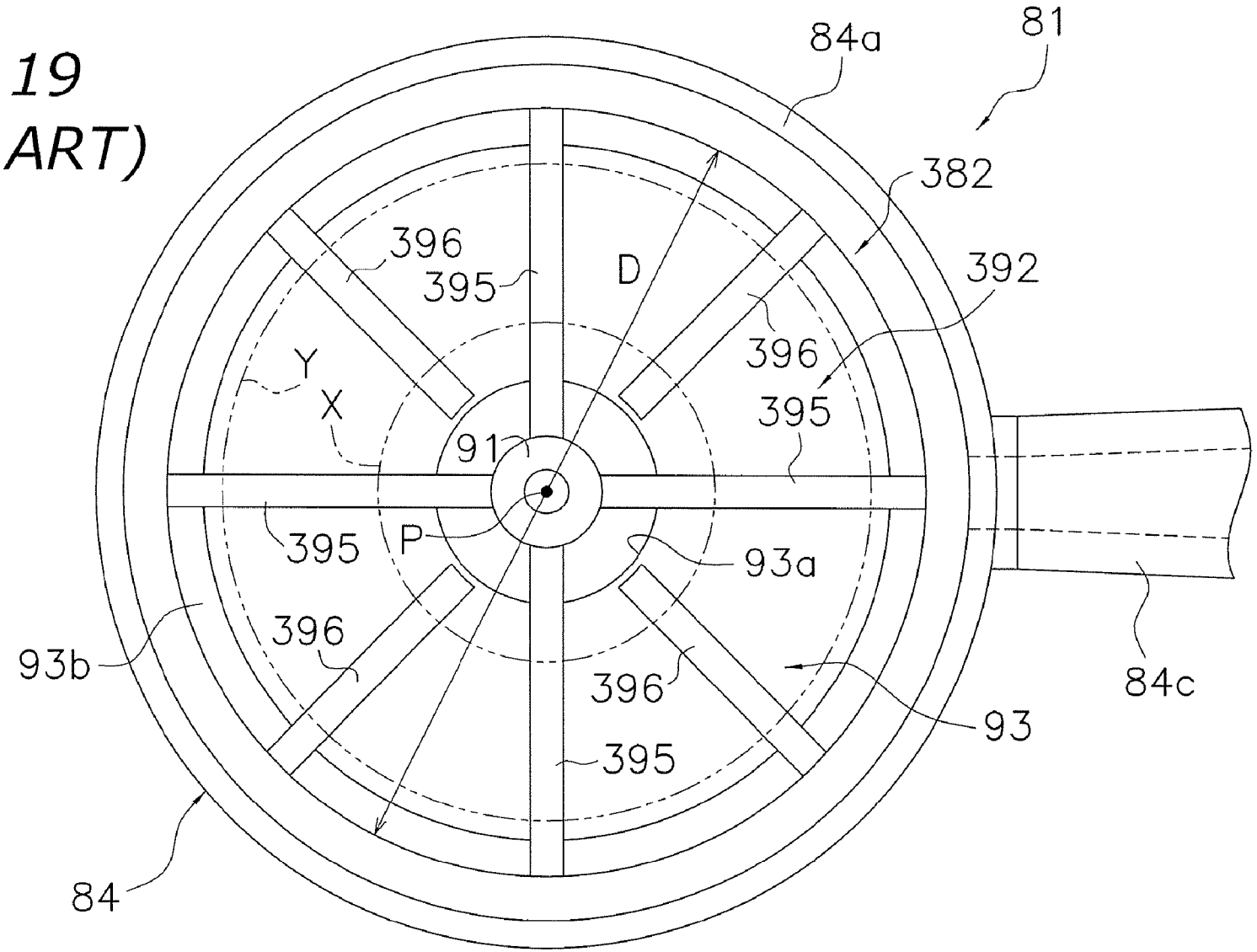
Fig. 19 (PRIOR ART)
FIG. 19 is a plan view of a conventional drain pump (the motor and the casing cover are not shown).
Figure 20:
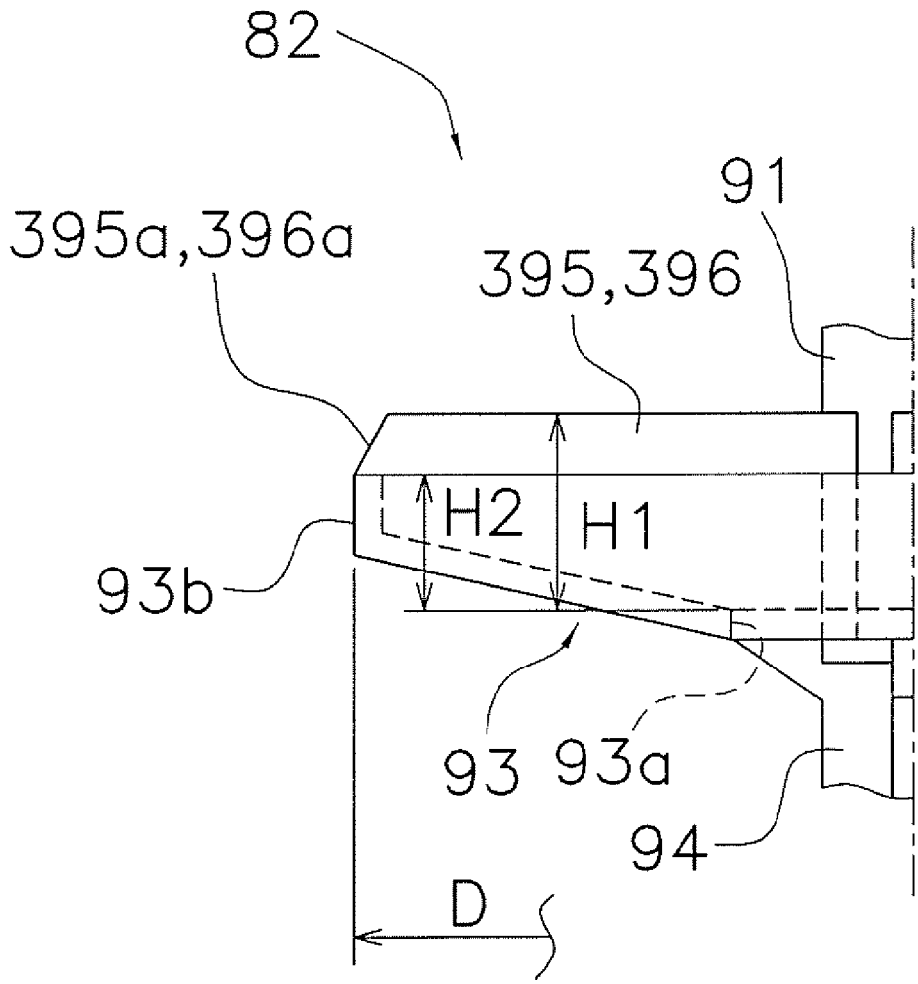
Fig. 20 (PRIOR ART)
FIG. 20 is a side view of the impeller of the drain pump according to another conventional example.

The following explains the experimental results obtained for the drain pump 8 comprising a main blade 92 having the inclined parts 95*a*, 96*a* of the present embodiment, and a drain pump 308 comprising a conventional main blade 392, wherein actual measurements were taken of the operating noise with the drain pump unmounted, and of the head, which is one measure of pump performance. Here, FIG. 3 graphs the actual measured values of the operating noise for an unmounted drain pump under various water level and head conditions. FIG. 4 graphs the actual measured values of the head at various rotational speeds. In addition, two drain pumps were prepared as conventional drain pumps: a drain pump comprising a main blade not having an inclined part, as shown in FIG. 18 (hereinafter, referred to as the conventional example 1); and a drain pump comprising a main blade having inclined parts 395*a*, 396*a* formed only at the portion more on the upper side than the upper end part of the partition part 93*b* shown in FIG. 20 (hereinafter, referred to as the conventional example 2); and actual measurements of the operating noise and the head were conducted.

Figure 3:
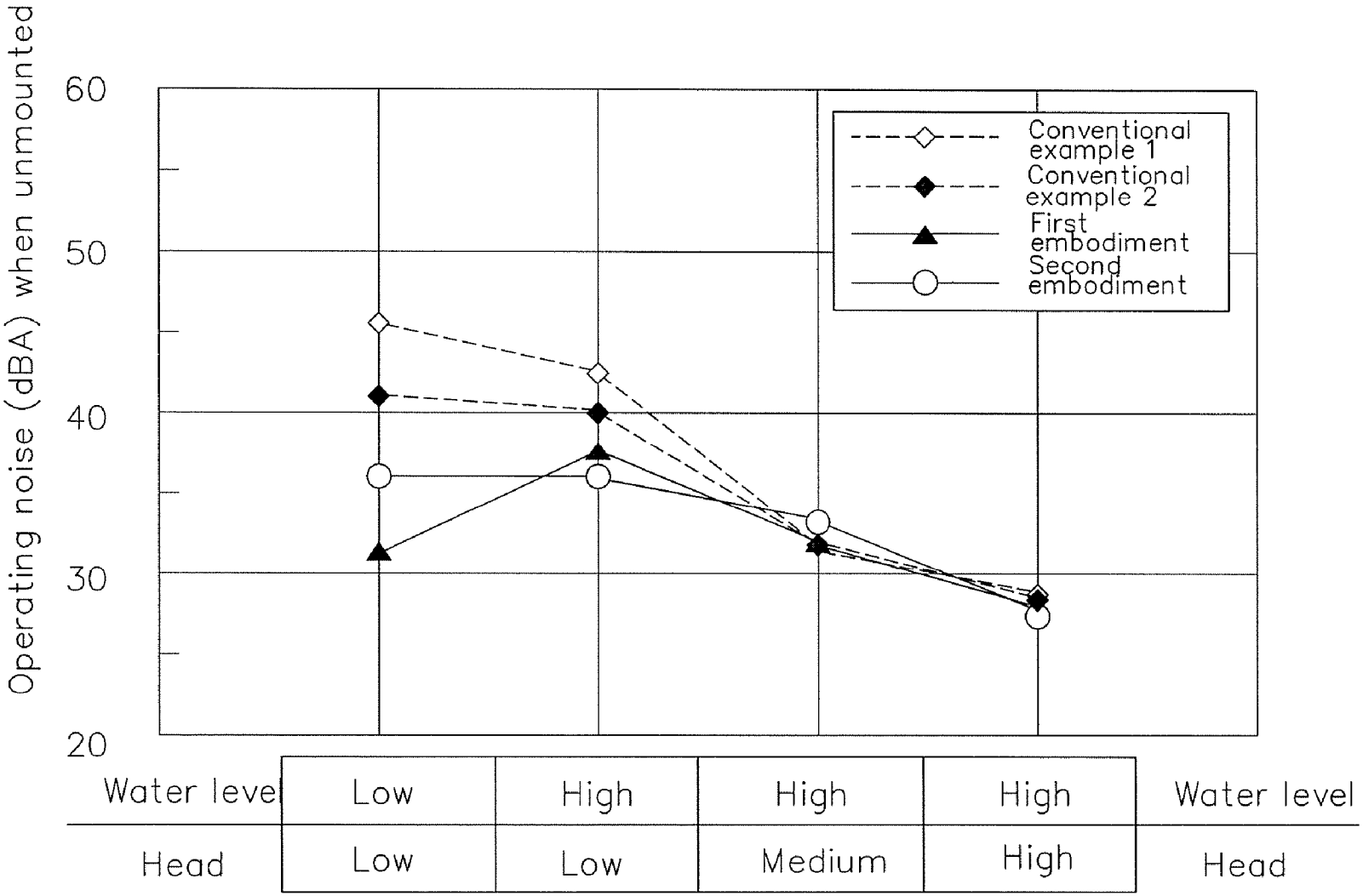
FIG. 3 graphs the actual measured values of the operating noise, under various water level and head conditions, with the drain pump unmounted.
Figure 4:
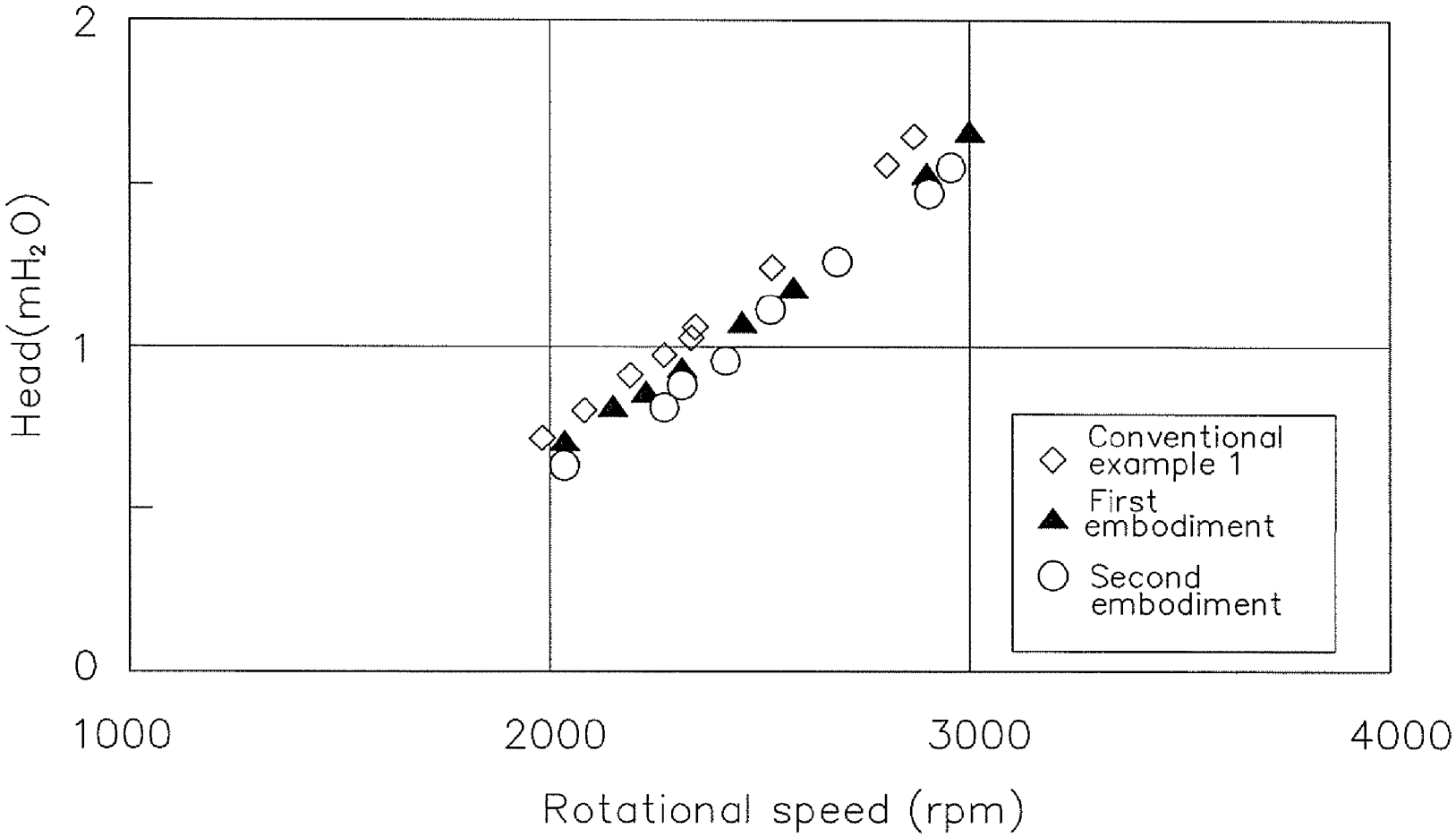
FIG. 4 graphs the actual measured values of the head under various rotational speeds.

With the drain pump of the conventional example 1, as shown in FIG. 3, the operating noise is greatest (approximately 46 dBA) when the water level and the head are low, the operating noise decreases to approximately 43 dBA when the water level is high and the head is low, and the operating noise trends downward to about 30 dBA as the head increases. In addition, as shown in FIG. 4, the head trends upward as the rotational speed increases. In addition, with the drain pump of the conventional example 2, as shown in FIG. 3, the operating noise is lower than the conventional example 1 when the water level and the head are low, but the operating noise is greatest (approximately 42 dBA) when the water level and the head are low, the operating noise decreases to approximately 40 dBA when the water level is high and the head is low, and the operating noise trends downward to about 30 dBA as the head increases.

However, with the drain pump 8 of the present embodiment, as shown in FIG. 3, the operating noise is less than the operating noise of the drain pumps of the conventional examples 1 and 2 (approximately 32 dBA) when the water level and the head are low, the operating noise increases to approximately 37 dBA when the water level is high and the head is low (however, less than the operating noise of the drain pumps of the conventional examples 1 and 2 under the same conditions), and the operating noise trends downward to about 30 dBA as the head increases. In addition, as shown in FIG. 4, the head becomes slightly less than the head of the drain pump of the conventional example 1, but trends upward as the rotational speed increases.

Here, it is considered that the operating noise when the water level and the head are low is less than the operating noise of the drain pump of the conventional example 1 because the inclined parts 95*a*, 96*a* are formed at the outer circumferential part of the main blade 92, as discussed above. Moreover, it is less than the operating noise of the drain pump of the conventional example 2 because of the difference of the shapes of the inclined parts 95*a*, 96*a* formed in the main blade 92 of the drain pump 8 of the present embodiment and the inclined parts formed in the main blade of the drain pump of the conventional example 2. Specifically, this is attributable to the fact that the outer circumferential edge part of each of the inclined parts 95*a*, 96*a* formed in the main blade 92 of the drain pump 8 of the present embodiment is disposed at a position lower than the upper end part of the partition part 93*b*, while the inclined parts 395*a*, 396*a* formed in the main blade of the drain pump of the conventional example 2 are formed only in the portion more on the upper side than the upper end part of the partition part 93*b*. Moreover, with the drain pump 8 of the present embodiment, the outer circumferential edge part of the main blade 92 is disposed on the inner circumferential side of the inner circumferential surface of the partition part 93*b* of the dish part 93, and it is supposed that this consequently enhances the effect of softening the collision between the air-liquid interface Y and the main blade 92 at the outer circumferential edge part of the main blade 92. In addition, it is considered that the increase in the operating noise when the water level is high and the head is low is attributable to the fact that the inner circumferential part of the main blade 92 is the same shape as the main blade 392 of the drain pumps of the conventional example 1 and the conventional example 2.

Forming the inclined parts 95*a*, 96*a* in the main blade 92 slightly reduces the effective area by which the main blade 92 can perform the work of supplying water, but an effective area of the inner circumferential part of the main blade 92 is ensured; consequently, the decrease in the head is kept to a level wherein the head becomes slightly less than the head of the drain pump of the conventional example 1, and a drop in the pump performance of the drain pump 8 is suppressed as much as possible.

Thus, by disposing the outer circumferential edge part of the main blade 92 at a position lower than the upper end part of the partition part 93*b* as in the drain pump 8 of the present embodiment, a drop in the pump performance is suppressed, and the effect was confirmed that the operating noise can be effectively reduced at times of low head, and particularly when a low head operating condition overlaps with a low water level operating condition.

Second Embodiment

(1) Constitution and Operation of the Drain Pump

Figure 5:
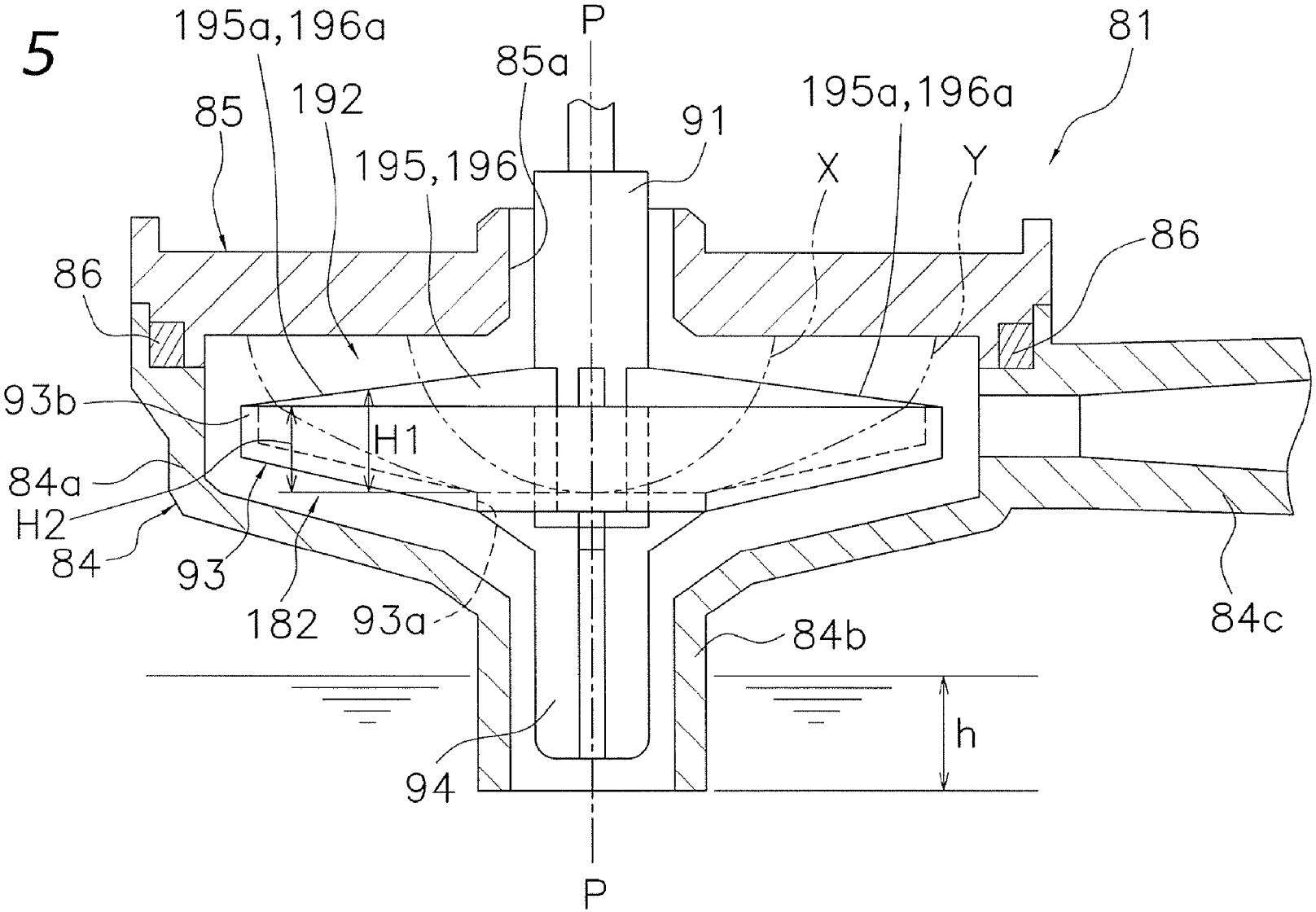
FIG. 5 is an enlarged view that depicts the vicinity of the pump casing of the drain pump according to the second embodiment of the present invention.
Figure 6:
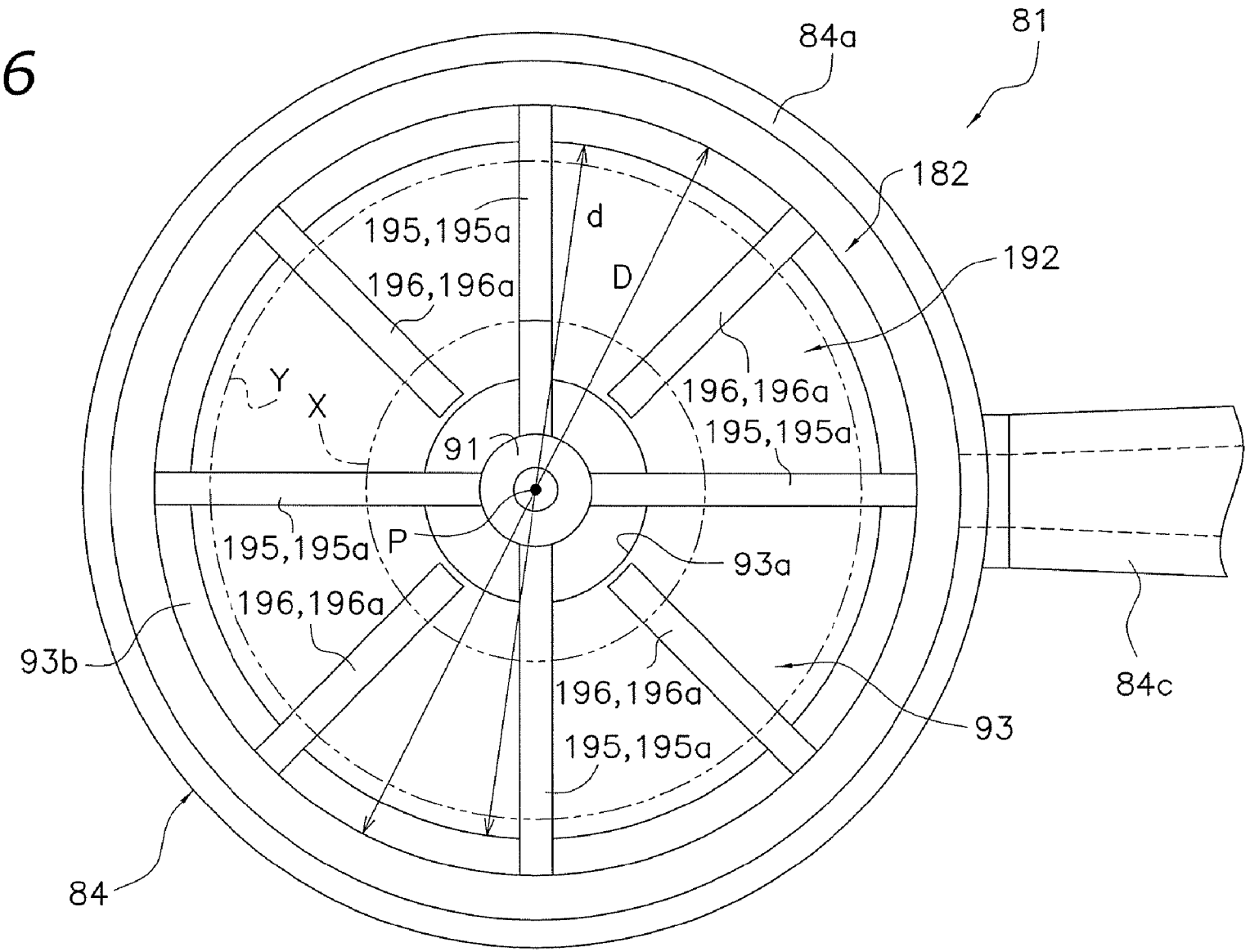
FIG. 6 is a plan view of the drain pump (the motor and the casing cover are not shown) according to the second embodiment of the present invention.

FIG. 5 and FIG. 6 depict a drain pump 108 according to the second embodiment of the present invention used in an air conditioner 1 (refer to FIG. 14 through FIG. 16), and the like. Here, FIG. 5 is an enlarged view that depicts the vicinity of the pump casing 81 of the drain pump 108 according to the second embodiment of the present invention. FIG. 6 is a plan view of the drain pump 108 (the motor 83 and the casing cover 85 are not shown) according to the second embodiment of the present invention. Furthermore, excepting an impeller 182, the explanation of the drain pump 108 is abbreviated because its constitution is the same as that of the conventional drain pump 308.

The impeller 182 principally comprises: the shaft part 91 coupled to the drive shaft of the motor 83; a main blade 192 disposed inside the main body part 84*a* of the pump casing 81; an auxiliary blade 94 disposed on the lower side of the main blade 192; and the disc shaped dish part 93 disposed between the main blade 192 and the auxiliary blade 94, and having an opening 93*a* comprising an annular through hole in the center. Here, excepting the main blade 192, the explanation of the impeller 182 is abbreviated because its constitution is the same as the conventional impeller 382.

The main blade 192 comprises, for example: four first blades 195 extending radially from the outer circumferential surface of the shaft part 91; and four second blades 196 extending radially from the outer circumferential edge part of the opening 93*a* of the dish part 93, and disposed between the first blades 195 in the circumferential direction. Furthermore, the number of first blades 195 and second blades 196 that constitute the main blade 192 is not limited to the abovementioned number, and various numbers thereof can be chosen.

Each first blade 195 is formed so that the height position of the upper end part of the first blade 195 (hereinafter, as shown in FIG. 5, the height of each first blade 195 and each second blade 196 from the upper end surface of the opening 93*a* is defined as the blade height H1) decreases from the inner circumferential edge part to the outer circumferential edge part thereof (specifically, the upper end part of the outer circumferential edge part of the partition part 93*b*). In other words, the inclined part 195*a* formed only at the outer circumferential part of each first blade 95 of the first embodiment is formed over each entire first blade 195. In addition, an inclined part 196*a* is formed so that the blade height H1 of the upper end part of each second blade 196 decreases from the inner circumferential edge part toward the outer circumferential edge part thereof, the same as each first blade 195. In other words, the inclined part 196*a* formed only at the outer circumferential part of each second blade 96 of the first embodiment is formed over each entire second blade 196. Furthermore, the outer circumferential edge part of each first blade 195 and each second blade 196 is disposed at the same height position as the upper end part of the partition part 93*b* (specifically, the dish height H2), and the outer circumferential edge part of each first blade 195 and each second blade 196 is not disposed at a position lower than the upper end part of the partition part 93*b*, the same as the inclined parts 95*a*, 96*a* of the first embodiment. Furthermore, because these inclined parts 195*a*, 196*a* are formed across the main blade 192 from the inner circumferential edge part to the outer circumferential edge part (specifically, from the outer circumferential surface of the shaft part 91 to the outer circumferential edge part of the partition part 93*b*), its inclination is gradual compared with the inclined parts 95*a*, 96*a* of the first embodiment. Thus, the blade height H1 of each first blade 195 and each second blade 196 is less at the outer circumferential part than at the inner circumferential part. Furthermore, each of the inclined parts 195*a*, 196*a* may be shaped linearly inclined, as shown in FIG. 5, and may be shaped inclined so that it describes a curved surface.

With a drain pump 108 having a main blade 192 wherein such inclined parts 195*a*, 196*a* are formed, the air layer expands circularly concentric with the shaft part 91 of the main blade 192 as the water level h falls, the same as the inside of the main body part 84*a* of the conventional drain pump 308. Particularly when the head is low, the air-liquid interface between the air and the water (refer to an air-liquid interface Y in FIG. 5 and FIG. 6) expands to the outer circumferential part where the circumferential velocity is high.

However, with the drain pump 108, by forming the inclined parts 195*a*, 196*a* over the entire main blade 192, the blade height H1 is lower at the outer circumferential part than at the inner circumferential part, which can soften the collision between the air-liquid interface Y and the outer circumferential part of the main blade 192, and it is consequently possible to reduce the operating noise generated by the agitation of the air layer by the main blade 192.

Moreover, as the water level h rises, the air layer shrinks (refer to an air-liquid interface X in FIG. 5 and FIG. 6); however, even in this case, the inclined parts 195*a*, 196*a* formed over the entire main blade 192 can soften the collision between the air-liquid interface X and the main blade 192, and the operating noise generated by the main blade 192 agitating the air layer can be reduced.

Thus, with this drain pump 108, it is possible to soften the collision between the air-liquid interface and the main blade 192 in any of these cases: the case where, when the head is low, the air-liquid interface between the air and the water expands to the outer circumferential part, where the circumferential velocity is high; and the case where, when the head is low, the air-liquid interface is positioned at the inner circumferential part, more so in the case when the water level is rising than when the water level is low; consequently, the operating noise can be reduced when the head is low even when the position of the air-liquid interface varies due to variations in the water level. In addition, because such a drain pump 108 having a low operating noise when the head is low is used to discharge the drain water collected in the drain pan 7 of the air conditioner 1, it becomes possible to reduce the noise of the entire air conditioner 1, and problems such as the operating noise of the drain pump becoming a disturbance tend not to occur in cases such as when the flow rate of the fan 4 of the air conditioner 1 is low, or when the interior of the air conditioned room is quiet.

(2) Examples of Experiments

The following explains, referencing FIG. 3 and FIG. 4, the experimental results obtained for the drain pump 108 comprising the main blade 192 having the inclined parts 195*a*, 196*a* of the present embodiment, and the drain pump 308 comprising the conventional main blade 392, wherein actual measurements were taken of the operating noise with the drain pump unmounted, and of the head, which is one measure of pump performance.

With the drain pump 108 of the present embodiment, as shown in FIG. 3, the operating noise is less than the operating noise of the drain pump of the conventional examples 1 and 2 (approximately 36 dBA; however, larger than the operating noise of the drain pump 8 of the first embodiment under the same conditions) when the water level and the head are low, the operating noise decreases to approximately 35 dBA (moreover, less than the operating noise of the drain pump 8 of the first embodiment under the same conditions) when the water level is high and the head is low, and, further, the operating noise trends downward to about 30 dBA as the head increases. In addition, as shown in FIG. 4, the head decreases to a point slightly less than the head of the drain pump of the conventional example 1 (however, on par with the head of the drain pump 8 of the first embodiment), but trends upward as the rotational speed increases.

Here, it is considered that the operating noise when the water level and the head are low is less than the operating noise of the drain pump of the conventional example 1 because the inclined parts 195*a*, 196*a* are formed at the outer circumferential part of the main blade 192, as discussed above. In addition, it is considered that the operating noise is greater than the operating noise of the drain pump 8 of the first embodiment because: the inclination of the inclined parts 195*a*, 196*a* is gentler than the inclination of the inclined parts 95*a*, 96*a* of the first embodiment; the outer circumferential edge part of the main blade 192 is not disposed at a position lower than the upper end part of the partition part 93*b*; and the effect of softening the collision between the air-liquid interface and the main blade 192 at the outer circumferential part of the main blade 192 is somewhat less than that of the inclined parts 95*a*, 96*a* of the first embodiment. In addition, it is considered that the operating noise is lower than the operating noise of the drain pump of the conventional example 2 when the water level and the head are low because the inclined parts 195*a*, 196*a* are formed not only at the outer circumferential part of the main blade 192, but over the entire main blade 192. Furthermore, it is considered that the operating noise is reduced when the water level is high and the head is low because: the inclined parts 195*a*, 196*a* are formed over the entire main blade 92; and the effect of softening the collision between the air-liquid interface and the main blade 192 at the inner circumferential part of the main blade 192 is obtained, unlike the main blade of the drain pump of the conventional examples 1 and 2, and unlike the main blade 92 of the drain pump 8 of the first embodiment.

Forming the inclined parts 195*a*, 196*a* in the main blade 192 slightly reduces the effective area by which the main blade 192 can perform the work of supplying water, but, as a result of forming the inclined parts 195*a*, 196*a* over the entire main blade 92, an effective area of the outer circumferential part of the main blade 192 is ensured; consequently, on par with the drain pump 8 of the first embodiment, the decrease in the head is kept to a level wherein the head becomes slightly less than the head of the drain pump of the conventional example 1, and a drop in the pump performance of the drain pump 108 is suppressed as much as possible.

Thus, by forming the inclined parts 195*a*, 196*a* over the entire main blade 192 as in the drain pump 108 of the present embodiment, a drop in the pump performance is suppressed, the effect wherein the operating noise can be reduced not only when the head and the water level are low, but also when the head is low and the water level is high, was confirmed; as a result, it was seen that the effect of reducing variations in the operating noise due to variations in the head and water level was obtained.

Third Embodiment

(1) Constitution and Operation of the Drain Pump

Figure 7:
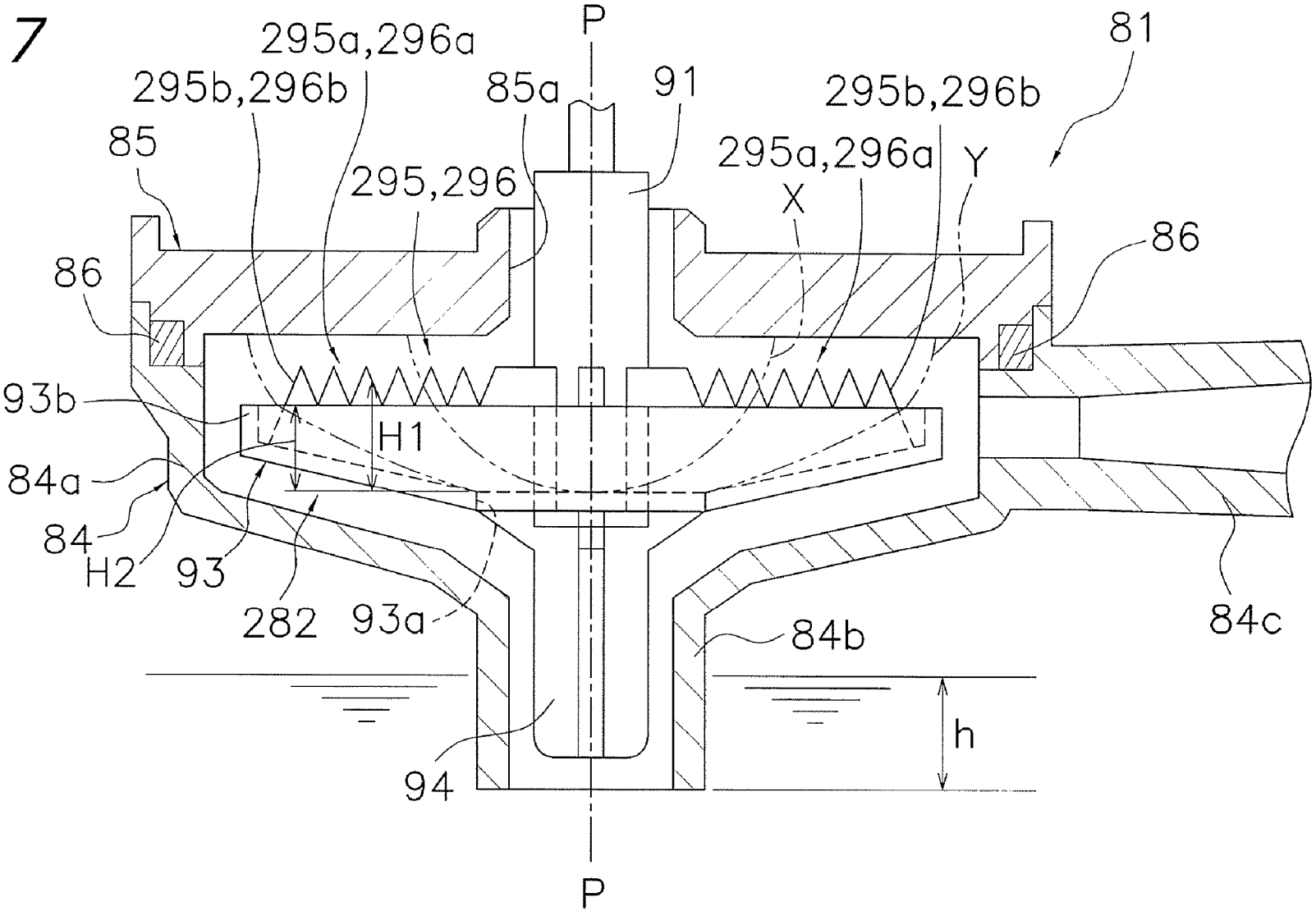
FIG. 7 is an enlarged view that depicts the vicinity of the pump casing of the drain pump according to the third embodiment of the present invention.
Figure 8:
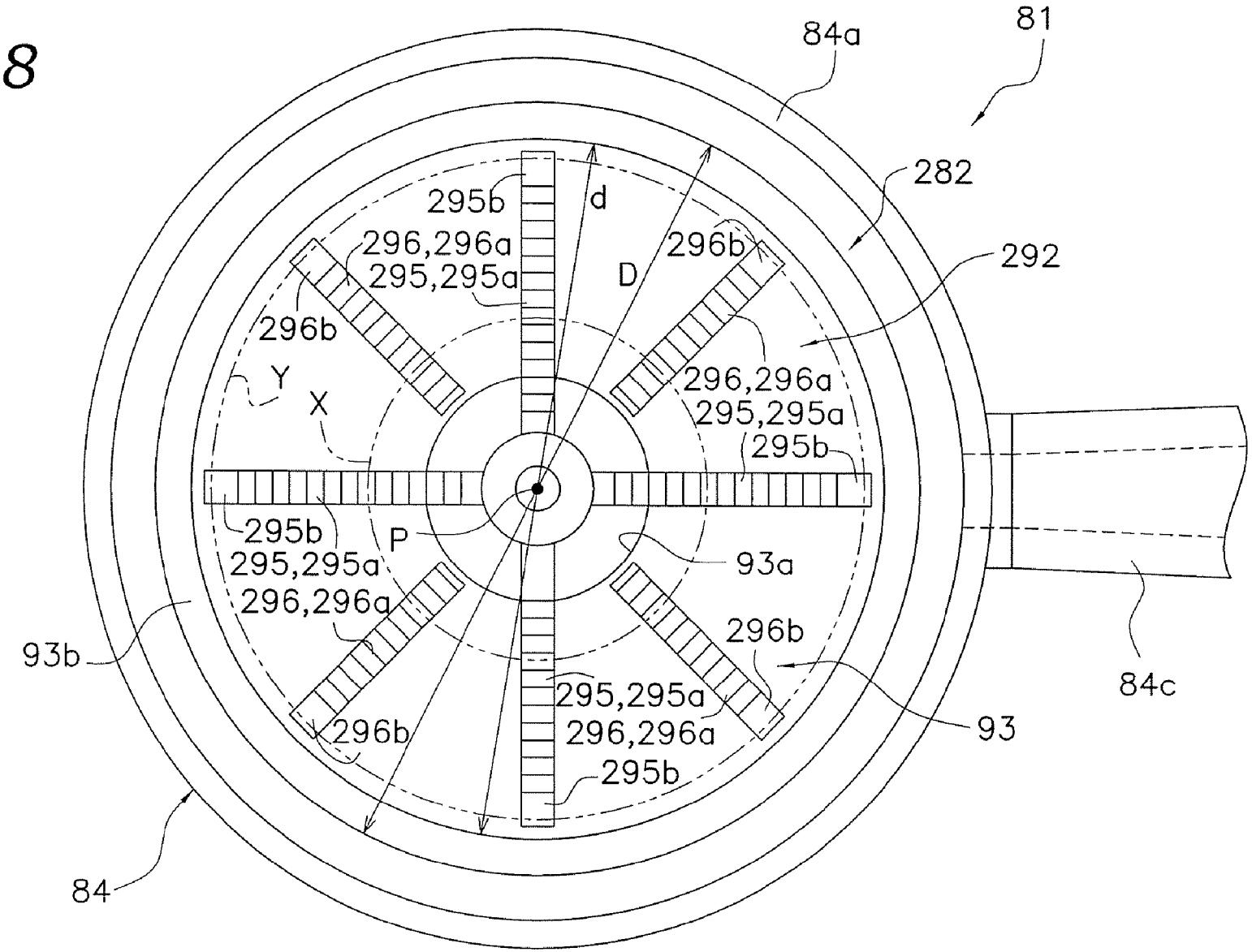
FIG. 8 is a plan view of the drain pump (the motor and the casing cover are not shown) according to the third embodiment of the present invention.

FIG. 7 and FIG. 8 depict a drain pump 208 according to the third embodiment of the present invention used in an air conditioner 1 (refer to FIG. 14 through FIG. 16), and the like. Here, FIG. 7 is an enlarged view that depicts the vicinity of the pump casing 81 of the drain pump 208 according to the third embodiment of the present invention. FIG. 8 is a plan view of the drain pump 208 (the motor 83 and the casing cover 85 are not shown) according to the third embodiment of the present invention. Furthermore, excepting an impeller 282, the explanation of the drain pump 208 is abbreviated because its constitution is the same as that of the conventional drain pump 308.

The impeller 282 principally comprises: the shaft part 91 coupled to the drive shaft of the motor 83; the auxiliary blade 94 disposed on the lower side of a main blade 292; and the disc shaped dish part 93 disposed between the main blade 292 and the auxiliary blade 94, and having the opening 93*a* comprising an annular through hole in the center. Here, excepting the main blade 292, the explanation of the impeller 282 is abbreviated because its constitution is the same as the conventional impeller 382.

The main blade 292 comprises, for example: four first blades 295 extending radially from the outer circumferential surface of the shaft part 91; and four second blades 296 extending radially from the outer circumferential edge part of the opening 93*a* of the dish part 93, and disposed between the first blades 295 in the circumferential direction. Furthermore, the number of first blades 295 and second blades 296 that constitute the main blade 292 is not limited to the abovementioned number, and various numbers thereof can be chosen.

Because a jagged part 295*a* is formed, the height position of the upper end part of each first blade 295 (hereinafter, as shown in FIG. 7, the height of each first blade 295 and each second blade 296 from the upper end surface of the opening 93*a* is defined as the blade height H1) varies with the jagged shape across each entire first blade 295 from the inner circumferential edge part to the outer circumferential edge part. In addition, because a jagged part 296*a* is formed, the blade height H1 of the upper end part of each second blade 296 varies with a jagged shape across the entire second blade 296 from the inner circumferential edge part to the outer circumferential edge part.

In the present embodiment, the jagged parts 295*a*, 296*a* are right triangle waveform shaped portions, and the outermost circumferential part thereof (hereinafter, referred to as inclined parts 295*b*, 296*b*) is shaped inclined so that the blade height H1 decreases toward the outer circumferential edge part. These inclined parts 295*b*, 296*b* are formed so that one part of the outer circumferential part of each first blade 295 and each second blade 296 is notched, and the outer circumferential edge part thereof is disposed at a position lower than the upper end part of the partition part 93*b* (specifically, the dish height H2).

In addition, the inclined parts 295*b*, 296*b* are notched so that the outer diameter of each first blade 295 and each second blade 296 is shorter than an external dimension D of the partition part 93*b*, and further is shorter than a diameter d of the inner circumferential surface of the partition part 93*b*. Consequently, the outer circumferential edge part of each first blade 295 and each second blade 296 is disposed on the inner circumferential side of the inner circumferential surface of the partition part 93*b*. Furthermore, the shape of the jagged parts 295*a*, 296*a* is not limited to those in the present embodiment, and other shapes, such as a rectangular waveform shape and a sine waveform shape, are also applicable.

With a drain pump 208 provided with a main blade 292 wherein jagged parts 295*a*, 296*a* having such inclined parts 295*b*, 296*b* are formed, the air layer expands circularly concentric with the shaft part 91 of the main blade 292 as the water level h falls, the same as the inside of the main body part 84*a* of the conventional drain pump 308. Particularly when the head is low, the air-liquid interface between the air and the water (refer to an air-liquid interface Y in FIG. 7 and FIG. 8) expands to the outer circumferential part where the circumferential velocity is high.

However, with the drain pump 208, the outer circumferential edge part of the main blade 292 is disposed at a position lower than the upper end part of the partition part 93*b* by the forming of the jagged parts 295*a*, 296*a* (specifically, the inclined parts 295*b*, 296*b*) at the outer circumferential part of the main blade 292, which can soften the collision between the air-liquid interface Y and the outer circumferential part of the main blade 292, and it is consequently possible to reduce the operating noise generated by the agitation of the air layer by the main blade 292, the same as the drain pump 8 as the first embodiment.

Moreover, as the water level h rises, the air layer shrinks (refer to the air-liquid interface X in FIG. 7 and FIG. 8); however, even at this time, if the jagged parts 295*a*, 296*a* are formed over the entire main blade 292, as in the present embodiment, then the jagged parts 295*a*, 296*a* can soften the collision between the air-liquid interface X and the main blade 292, the same as the drain pump 108 of the second embodiment, and it is possible to reduce the operating noise generated by the main blade 292 agitating the air layer.

Furthermore, because such a drain pump 208 having a low operating noise when the head is low is used to discharge the drain water collected in the drain pan 7 of the air conditioner 1, it becomes possible to reduce the noise of the entire air conditioner 1, and problems such as the operating noise of the drain pump becoming a disturbance tend not to occur in cases such as when the flow rate of the fan 4 of the air conditioner 1 is low, or when the interior of the air conditioned room is quiet.

Other Embodiments

The above explained embodiments of the present invention based on the drawings, but the specific constitution is not limited to these embodiments, and it is understood that variations and modifications may be effected without departing from the spirit and scope of the invention.

(1) Modified Example of the First Embodiment

Figure 9:
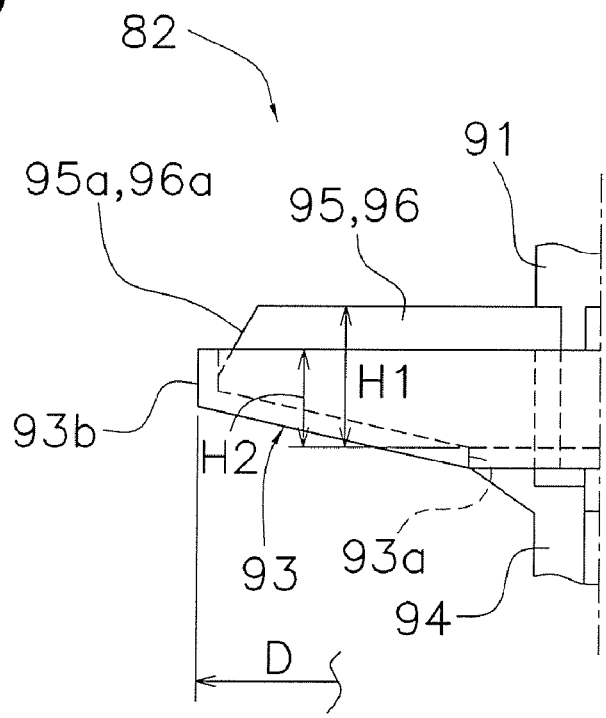
FIG. 9 is a side view of an impeller of the drain pump according to another embodiment of the present invention.

With the main blade 92 that constitutes the impeller 82 of the drain pump 8 of the first embodiment, the outer circumferential edge part of each first blade 95 and each second blade 96 is disposed on the inner circumferential side of the inner circumferential surface of the partition part 93*b* due to the notching so that the inclined parts 95*a*, 96*a* are shorter than the diameter d of the inner circumferential surface of the partition part 93*b*; however, as shown in FIG. 9, the outer circumferential edge part of each of the inclined parts 95*a*, 96*a* may be formed so that it comes in contact with the inner circumferential surface of the partition part 93*b*.

Even in this case, because the outer circumferential edge part of each first blade 95 and each second blade 96 is disposed at a position lower than the upper end part of the partition part 93*b*, it is supposed that the operating noise when the head is low can be reduced more than the drain pumps of the conventional examples 1 and 2.

Figure 10:
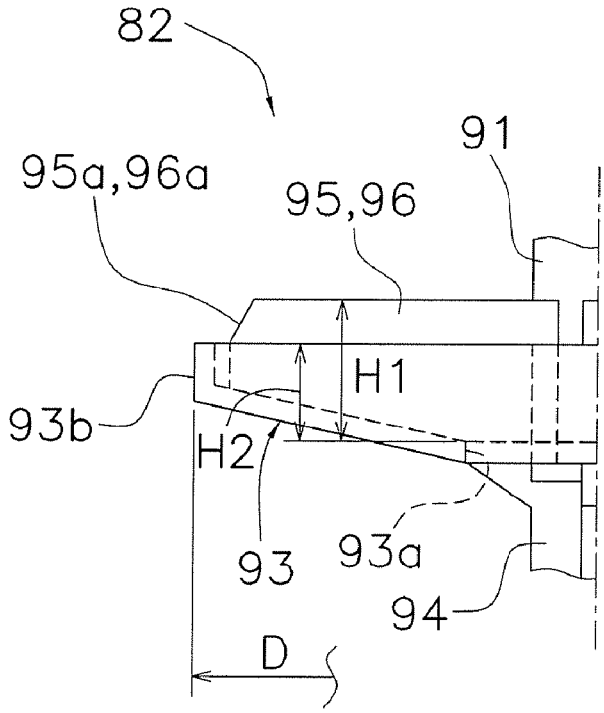
FIG. 10 is a side view of the impeller of the drain pump according to another embodiment of the present invention.
Figure 11:
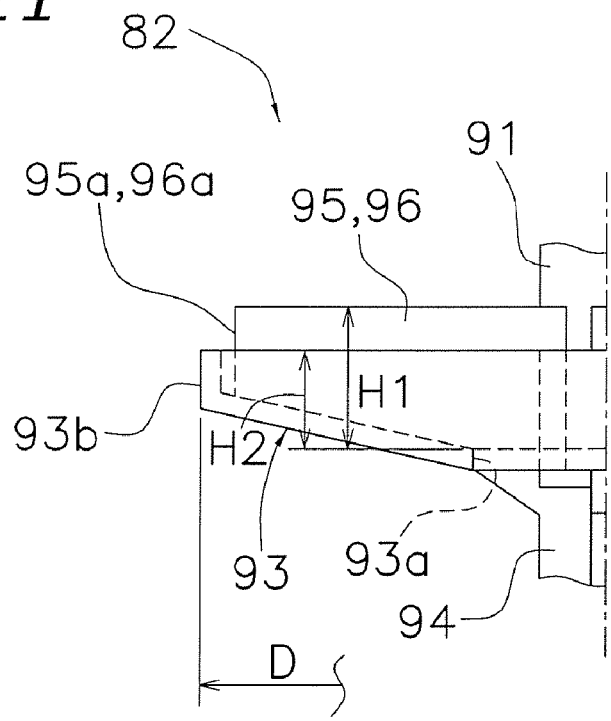
FIG. 11 is a side view of the impeller of the drain pump according to another embodiment of the present invention.

In addition, with the main blade 92 that constitutes the impeller 82 of the drain pump 8 of the first embodiment, the inclined parts 95*a*, 96*a* are shaped inclined so that the blade height H1 decreases linearly toward the circumferential edge part; however, as shown in FIG. 10, one part of the outer circumferential part of each first blade 95 and each second blade 96 may be of a shape that is notched in a polygon shape; and, as shown in FIG. 11, one part of the outer circumferential part of each first blade 95 and each second blade 96 may be of a shape that is straightly notched in the vertical direction.

Even in this case, it is supposed that the operating noise when the head is low can be reduced more than the drain pumps of the conventional examples 1 and 2 because the outer circumferential edge part of each first blade 95 and each second blade 96 is disposed at a position lower than the upper end part of the partition part 93*b*.

(2) Modified Example of the Second Embodiment

Figure 12:
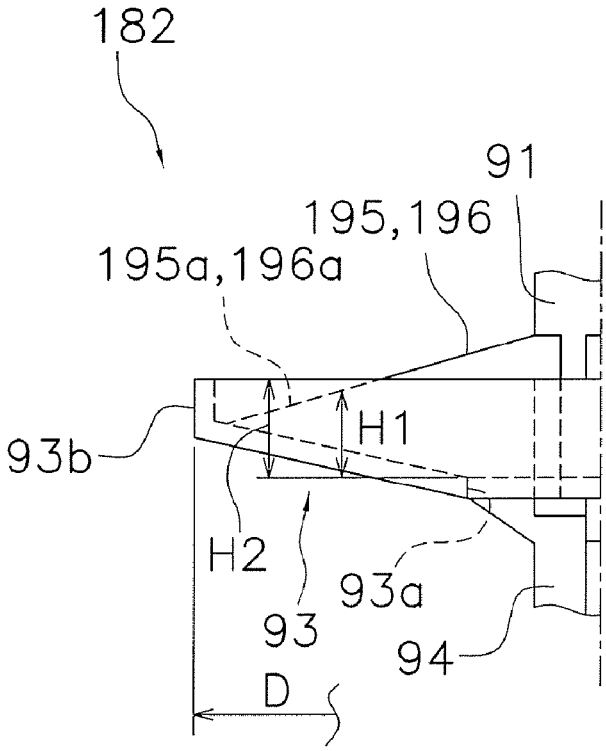
FIG. 12 is a side view of the impeller of the drain pump according to another embodiment of the present invention.

With the main blade 192 that constitutes the impeller 182 of the drain pump 108 of the second embodiment, the inclined parts 195*a*, 196*a* are formed so that the blade height decreases from the inner circumferential edge part of each first blade 195 and each second blade 196 toward the outer circumferential edge part (specifically, the upper end part of the outer circumferential edge part of the partition part 93*b*), and the collision between the air-liquid interfaces X, Y and the main blade 192 over the entire main blade 192 can reliably be softened, thus reducing the operating noise when the head is low (refer to FIG. 3); however, as shown in FIG. 12, the outer circumferential edge parts of the inclined parts 195*a*, 196*a* may be disposed at a position lower than the upper end part of the partition part 93*b*, the same as the inclined parts 95*a*, 96*a* of the first embodiment, and may be notched so that the inclined parts 195*a*, 196*a* become shorter than the diameter d of the inner circumferential surface of the partition part 93*b*.

In this case, it is supposed that the operating noise can be further reduced when the head and the water level are low because the effect of softening the collision between the air-liquid interface and the main blade 92 at the outer circumferential part of the main blade 92 can be enhanced.

(3) Modified Example of the Third Embodiment

Figure 13:
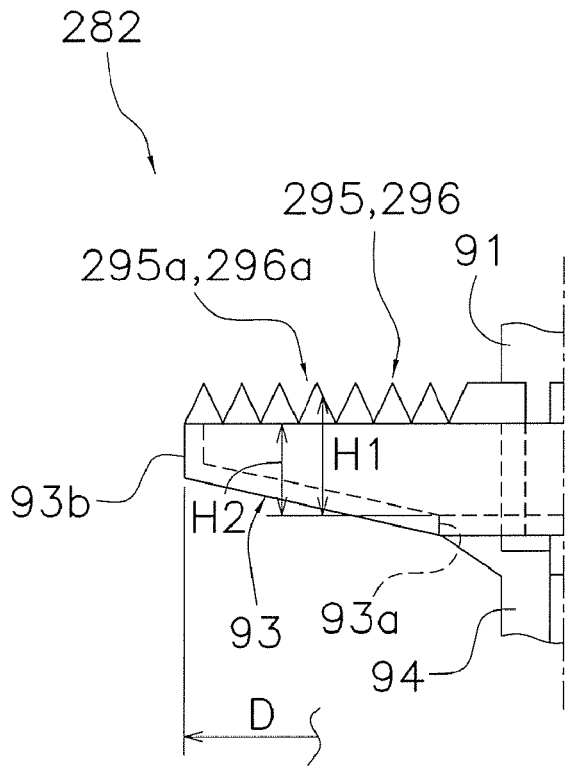
FIG. 13 is a side view of the impeller of the drain pump according to another embodiment of the present invention.

With the main blade 292 that constitutes the impeller 282 of the drain pump 208 of the third embodiment, the inclined parts 295*b*, 296*b* are formed by notching one part of the outer circumferential part of each first blade 295 and each second blade 296 so that the outer diameter of each first blade 295 and each second blade 296 is shorter than the external dimension D of the partition part 93*b*, which enables the reliable softening of the collision between the air-liquid interface Y and the main blade 292 at the outer circumferential part of the main blade 292, thereby significantly reducing the operating noise when the head and the water level are low (refer to FIG. 3); however, as shown in FIG. 13, one part of the outer circumferential part may be formed so that it is notched toward the outer circumferential edge part of the partition part 93*b*, without making the outer diameter of each first blade 295 and each second blade 296 less than the external dimension D of the partition part 93*b*.

In so doing, the effect of softening the collision between the air-liquid interface and the main blade 292 at the outer circumferential part of the main blade 292 decreases; nevertheless, it is supposed that it will obtain the effect of reducing the operating noise on par with the drain pump 108 of the second embodiment.

INDUSTRIAL FIELD OF APPLICATION

Using the present invention enables a reduction in the operating noise of the drain pump when the head is low.

What is claimed is:

1. A drain pump, comprising:

a casing including a drain inlet configured to suck in drain water at a lower end part, and a drain outlet configured to discharge drain water at a side part; and an impeller including a shaft part extending in a vertical direction within said casing, a main blade disposed on an outer circumferential side of said shaft part, an auxiliary blade disposed on a lower side of said main blade, and a disc shaped dish part disposed between said main blade and said auxiliary blade, said main blade being formed so that a blade height of said main blade decreases from an inner circumferential edge part of said main blade toward an outer circumferential edge part of said main blade, and at least a portion of a radially extending outward edge of the main blade is angularly inclined relative to the rotational axis of said shaft part, said portion of said radially extending outward edge of said main blade being arranged on a side of said main blade opposite said auxiliary blade.

2. An air conditioner including the drain pump of claim 1, the air conditioner comprising:

a heat exchanger; and a drain pan configured to collect drain water generated by said heat exchanger, with the drain pump being arranged to discharge the drain water collected in said drain pan.

3. A drain pump comprising:

a casing including a drain inlet configured to suck in drain water at a lower end part, and a drain outlet configured to discharge drain water at a side part; and an impeller including a shaft part extending in a vertical direction within said casing, a main blade disposed on an outer circumferential side of said shaft part, an auxiliary blade disposed on a lower side of said main blade, and a disc shaped dish part disposed between said main blade and said auxiliary blade, and said dish part including an annular partition part extending upward from an outer circumferential edge part of said dish part to an upper end of said partition part, the inner circumferential part of a side of said main blade opposite said auxiliary blade being disposed at a position higher than the upper end part of said partition part and the outer circumferential edge part of said side of said main blade opposite said auxiliary blade being disposed at a position lower than the upper end part of said partition part.

4. An air conditioner including the drain pump of claim 3, the air conditioner comprising:

a heat exchanger; and a drain pan configured to collect drain water generated by said heat exchanger, with the drain pump being arranged to discharge the drain water collected in said drain pan.

* * * * *